US012607383B2

(12) United States Patent
Hong et al.

(10) Patent No.: US 12,607,383 B2
(45) Date of Patent: Apr. 21, 2026

(54) AIR CONDITIONER

(71) Applicant: SAMSUNG ELECTRONICS CO., LTD., Suwon-si (KR)

(72) Inventors: Jinwoo Hong, Suwon-si (KR); Donghyun Kim, Suwon-si (KR); Sungwoo Kim, Suwon-si (KR); Hyunho Kim, Suwon-si (KR); Hyojin Kim, Suwon-si (KR); Moonsun Shin, Suwon-si (KR); Jaehyoung Sim, Suwon-si (KR); Joonho Yoon, Suwon-si (KR); Sungjune Cho, Suwon-si (KR); Wangbyung Chae, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 710 days.

(21) Appl. No.: 17/953,795

(22) Filed: Sep. 27, 2022

(65) Prior Publication Data

US 2023/0175728 A1 Jun. 8, 2023

Related U.S. Application Data

(63) Continuation of application No. PCT/KR2022/011350, filed on Aug. 2, 2022.

(30) Foreign Application Priority Data

Dec. 7, 2021 (KR) ..... 10-2021-0173502

(51) Int. Cl.
*F24F 13/06* (2006.01)

(52) U.S. Cl.
CPC ..... *F24F 13/06* (2013.01)

(58) Field of Classification Search
CPC ..... F24F 13/06; F24F 1/0047; F24F 1/0317; F24F 1/64; F24F 5/0092; F24F 7/10;
(Continued)

(56) References Cited

U.S. PATENT DOCUMENTS 3,409,766 A * 11/1968 Meckler ..... F21V 11/06 165/53
2008/0245083 A1* 10/2008 Tutunoglu ..... H05K 7/20827 62/428
2019/0225052 A1* 7/2019 Zenner ..... B60H 1/00835

FOREIGN PATENT DOCUMENTS

CN 101631958 A 1/2010
CN 211119685 U 7/2020
(Continued)

OTHER PUBLICATIONS

Kim, Yeong, KR20030079524 Translation.pdf, "Air-conditioner filled in ceiling", Oct. 2003, pp. 1-9.*
(Continued)

*Primary Examiner* — Avinash A Savani
*Assistant Examiner* — Ryan L Faulkner
(74) *Attorney, Agent, or Firm* — STAAS & HALSEY LLP

(57) ABSTRACT

An air conditioner may include: a first air conditioning unit disposed in a first space formed between a first ceiling and a second ceiling that is spaced downward from the ceiling inner wall and lower than the first ceiling, the first air conditioning unit configured to suction air from a second space recessed from the second ceiling toward the first ceiling; a second air conditioning unit disposed in the first space and to communicate with the first air conditioning unit and configured to discharge air introduced from the first air conditioning unit; and a guide device configured to guide the first air conditioning unit and the second air conditioning
(Continued)

unit to move from the first space toward the second space or to move from the second space toward the first space.

19 Claims, 20 Drawing Sheets

(58) Field of Classification Search
CPC .... F24F 13/068; F24F 13/072; F24F 2221/14; F24F 13/078; F24F 2221/02
USPC ..... 454/339
See application file for complete search history.

(56) References Cited

FOREIGN PATENT DOCUMENTS

| | | | | |
|---|---|---|---|---|
| EP | 2520869 | A1 * | 11/2012 | ..... F24F 1/0047 |
| EP | 2 520 869 | B1 | 8/2018 | |
| JP | H0784930 | B2 * | 9/1995 | |
| JP | 10-332169 | | 12/1998 | |
| JP | 3037088 | | 4/2000 | |
| JP | 2012-233646 | | 11/2012 | |
| JP | 2013-174399 | | 9/2013 | |
| JP | 2015-68550 | | 4/2015 | |
| JP | 5786086 | | 9/2015 | |
| JP | 2022-57723 | | 4/2022 | |
| KR | 20030079524 | A * | 10/2003 | |
| KR | 10-0626433 | | 9/2006 | |
| KR | 10-2007-0053400 | | 5/2007 | |

OTHER PUBLICATIONS

Yamada, Masashi, JPH0784930 Translation.pdf, "Air conditioner set in ceiling", Sep. 1995, pp. 1-7.*
International Search Report dated Nov. 25, 2022 issue in PCT Application No. PCT/KR2022/011350.
Written Opinion dated Nov. 25, 2022 issue in PCT Application No. PCT/KR2022/011350.

* cited by examiner

AIR CONDITIONER

CROSS-REFERENCE TO RELATED APPLICATIONS

This application is a continuation application, under 35 U.S.C. § 111(a), of International Patent Application No. PCT/KR2022/011350, filed on Aug. 2, 2022, which claims the benefit of Korean Patent Application No. 10-2021-0173502, filed Dec. 7, 2021, in the Korean Intellectual Property Office, the entire disclosure of which is incorporated herein by reference as a part of this application.

BACKGROUND

Field

The disclosure relates to an air conditioner, and to an air conditioner having an improved structure.

Description of Related Art

In general, an air conditioner is an apparatus which controls temperature, humidity, and air current distribution to be suitable for human activities and removes dust from air by using a refrigeration cycle.

A ceiling type air conditioner includes an outdoor unit and an indoor unit. The outdoor unit may include a compressor, an outdoor heat exchanger, an expansion device, and the like, and the indoor unit may include an indoor heat exchanger, a blowing fan, and the like. An expansion device may be provided even in the indoor unit.

In general, for maintenance of the air conditioner, there is a need for disassembly of parts of the air conditioner or entry into the interior of the air conditioner. In the case of a ceiling-type air conditioner that is arranged to be suspended from or buried into the ceiling, maintenance may not be easy. For example, a service, such as replacement or inspection of parts of a ceiling-type air conditioner, takes a long time or requires a lot of manpower.

SUMMARY

According to an aspect of the disclosure, there is provided an air conditioner including: a first air conditioning unit disposed in a first space formed between a first ceiling and a second ceiling that is spaced downward from the first ceiling and lower than the first ceiling, the first air conditioning unit configured to suction air from a second space recessed from the second ceiling toward the first ceiling; a second air conditioning unit disposed in the first space and to communicate with the first air conditioning unit and configured to discharge air introduced from the first air conditioning unit; and a guide device configured to guide the first air conditioning unit and the second air conditioning unit to move from the first space toward the second space or to move from the second space toward the first space.

The first air conditioning unit and the second air conditioning unit may be detachably coupled to each other, and the air conditioner may further include a locking device configured to couple the first air conditioning unit to the second air conditioning unit.

The air conditioner may further include an unlocking device to be connected to the locking device to release the coupling between the first air conditioning unit and the second air conditioning unit by the locking device.

The first air conditioning unit may further include a first housing supported by the first ceiling and a suction port formed at a lateral side of the first housing while communicating with the second space; and the second air conditioning unit may further include a second housing supported by the first ceiling and detachably coupled to the first housing and a discharge port formed at a lower side of the second housing to discharge the air introduced from the first air conditioning unit.

In response to separating the first housing of the first air conditioning unit and the second housing of the second air conditioning unit from each other, each of the first air conditioning unit and the second air conditioning unit may be withdrawable from the first space through the second space.

The guide device may include: a first guide member configured to guide the first air conditioning unit, the first guide member including a first moving roller slidably movable along a guide rail installed on the first ceiling and a first support member connected to the first moving roller to support the first housing; and a second guide member configured to guide the second air conditioning unit, the second guide member including a second moving roller slidably movable along the guide rail and a second support member connected to the second moving roller to support the second housing.

The guide device may include: a first moving rail configured to guide the first air conditioning unit, the first moving rail formed on the first housing of the first air conditioning unit and slidably movable along a guide rail disposed between the first ceiling and the second ceiling; and a second moving rail configured to guide the second air conditioning unit, the second moving rail formed on the second housing of the second air conditioning unit and slidably movable along the guide rail.

The locking device may further include: a locking portion formed on one of the first air conditioning unit and the second air conditioning unit, and a hook formed on an other one of the first air conditioning unit and the second air conditioning unit to be locked by the locking portion, and the unlicking device further includes a lever to separate the hook from the locking portion.

The unlocking device may further include a connection member connecting the lever to the hook and configured to rotate the hook in linkage with the lever.

The locking portion of the locking device may further include an inclined surface sloping upward in a direction in which the first air conditioning unit is coupled to the second air conditioning unit, and in response to coupling the first air conditioning unit and the second air conditioning unit to each other, the hook of the locking device may move along the inclined surface of the locking portion to be locked with the locking portion.

The air conditioner may further include: a heat exchanger accommodated in the first housing of the first air conditioning unit to exchange heat with the air suctioned through the suction port; and a blowing fan accommodated in the second housing of the second air conditioning unit to guide the air passed through the heat exchanger to flow toward the discharge port.

The air conditioner may further include a discharge panel installed on the second ceiling to correspond to the discharge port and exposed downward of the second ceiling.

A maximum length of the first air conditioning unit in a moving direction of the first air conditioning unit may be smaller than a minimum length of the second space in the moving direction, and a maximum length of the second air conditioning unit in the moving direction may be smaller than the minimum length of the second space in the moving direction.

The locking device may further include a torsion spring to elastically bias the hook in a direction in which the hook is locked with the locking portion.

Each of the first moving roller and the second moving roller may further include: a roller body forming a moving center; and roller wheels formed at opposite ends of the roller body to be supported by the guide rail, and to rotate on the guide rail, wherein the guide rail may further include: a seating portion on which the roller wheels are seated; and a separation preventing portion extending from the seating portion to prevent separation of the roller wheels.

According to an aspect of the disclosure, there is an air conditioner including: a first housing slidably movable in a first space formed between a first ceiling and a second ceiling that is spaced downward from the first ceiling by a first interval; a suction port formed in the first housing and configured to communicate with a second space formed by a horizontal panel spaced downward from the first ceiling by a second interval smaller than the first interval and a vertical panel extending from the horizontal panel toward the second ceiling, and to suction air from the second space therethrough; a heat exchanger accommodated in the first housing and to heat-exchange with the air suctioned through the suction port; a second housing detachably coupled to the first housing and slidably movable in the first space; a discharge port formed in the second housing to discharge air to indoors; and a blowing fan accommodated in the second housing to allow the air having heat exchanged with the heat exchanger to flow to the discharge port, and each of the first housing and the second housing is withdrawable from the first space through the second space.

The air conditioner may further include a locking device to allow the first housing and the second housing to be locked with each other and an unlocking device to move the locking device such that locking of the first housing and the second housing by the locking device is released.

The air conditioner may further include a guide device to guide a sliding movement of the first housing and a sliding movement of the second housing such that the first housing and the second housing are movable between the first space and the second space.

The locking device may further include a locking portion formed on the second housing and a hook formed on the first housing to be locked with the locking portion, and the unlocking device may further include a wire connected to the hook and a lever to pull the wire such that the hook is unlocked from the locking portion.

The air conditioner may further include a sealing member provided between the first housing and the second housing such that, in response to coupling the first housing to the second housing, air flowing in the first housing and the second housing is prevented from leaking to the outside of the first housing and the second housing.

BRIEF DESCRIPTION OF THE DRAWINGS

FIG. 5 is a side view illustrating an example of an air conditioner according to an embodiment.

FIG. 6 is a view schematically illustrating a lock released state of a locking device of an air conditioner according to an embodiment.

FIG. 7 is a view schematically illustrating a state of a first air conditioning unit of an air conditioner according to an embodiment slidably moved.

FIG. 8 is a view schematically illustrating a state of a first air conditioning unit of an air conditioner according to an embodiment withdrawn.

FIG. 9 is a view schematically illustrating a state of a second air conditioning unit of an air conditioner according to an embodiment slidably moved.

FIG. 10 is a view schematically illustrating a state of a second air conditioning unit of an air conditioner according to an embodiment withdrawn.

FIG. 15 is a side view illustrating an example of an air conditioner according to an embodiment.

FIG. 16 is a view schematically illustrating a lock released state of a locking device of an air conditioner according to an embodiment.

FIG. 17 is a view schematically illustrating a state of a first air conditioning unit of an air conditioner according to an embodiment slidably moved.

FIG. 18 is a view schematically illustrating a state of a first air conditioning unit of an air conditioner according to an embodiment withdrawn.

FIG. 19 is a view schematically illustrating a state of a second air conditioning unit of an air conditioner according to an embodiment slidably moved.

FIG. 20 is a view schematically illustrating a state of a second air conditioning unit of an air conditioner according to an embodiment withdrawn.

DETAILED DESCRIPTION

Figure 1:
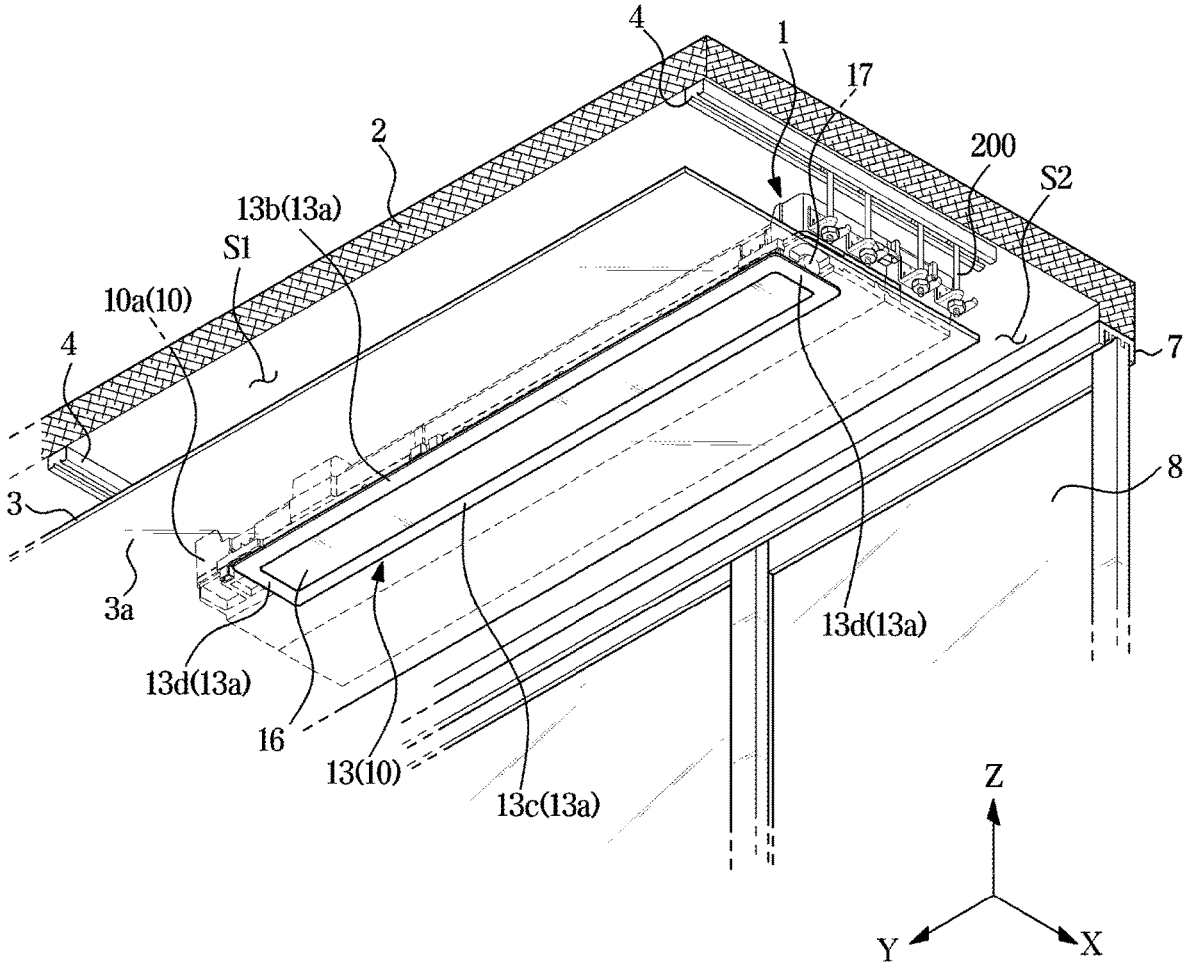
FIG. 1 is a perspective view illustrating an example of an air conditioner according to an embodiment.

Embodiments described in the specification and configurations shown in the accompanying drawings are merely examples of the disclosure, and various modifications may replace the embodiments and the drawings of the disclosure.

Further, identical symbols or numbers in the drawings of the disclosure denote components or elements configured to perform substantially identical functions.

Further, terms used herein are only for the purpose of describing particular embodiments and are not intended to limit to the disclosure. The singular form is intended to include the plural form as well, unless the context clearly indicates otherwise. It need to be further understood that the terms "include," "including," "have," and/or "having" specify the presence of stated features, integers, steps, operations, elements, components, and/or groups thereof, but do not preclude the presence or addition of one or more other features, integers, steps, operations, elements, components, and/or groups thereof.

When a part is referred to as being "connected to" another part, it may not only be directly connected to the other part but may in addition be indirectly connected to the other part. Similarly, when a part is referred to as being "coupled to" another part, it may not only be directly coupled to the other part but may in addition be indirectly coupled to the other part.

In the description of an embodiment, it will be understood that, when a layer is referred to as being "on/under" another layer or substrate, it may be directly on/under the other layer or substrate, or one or more intervening layers may in addition be present.

Further, it need to be understood that, although the terms "first," "second," etc. may be used herein to describe various elements, the elements are not limited by the terms, and the terms are only used to distinguish one element from another. For example, a first element could be termed a second element, and similarly, a second element could be termed a first element without departing from the scope of the disclosure. The term "and/or" includes combinations of one or all of a plurality of associated listed items.

On the other hand, the terms "front", "rear", "side", "down", etc. used in the following descriptions are defined based on the drawings, and the shape and position of each component is not limited by the terms.

Figure 2:
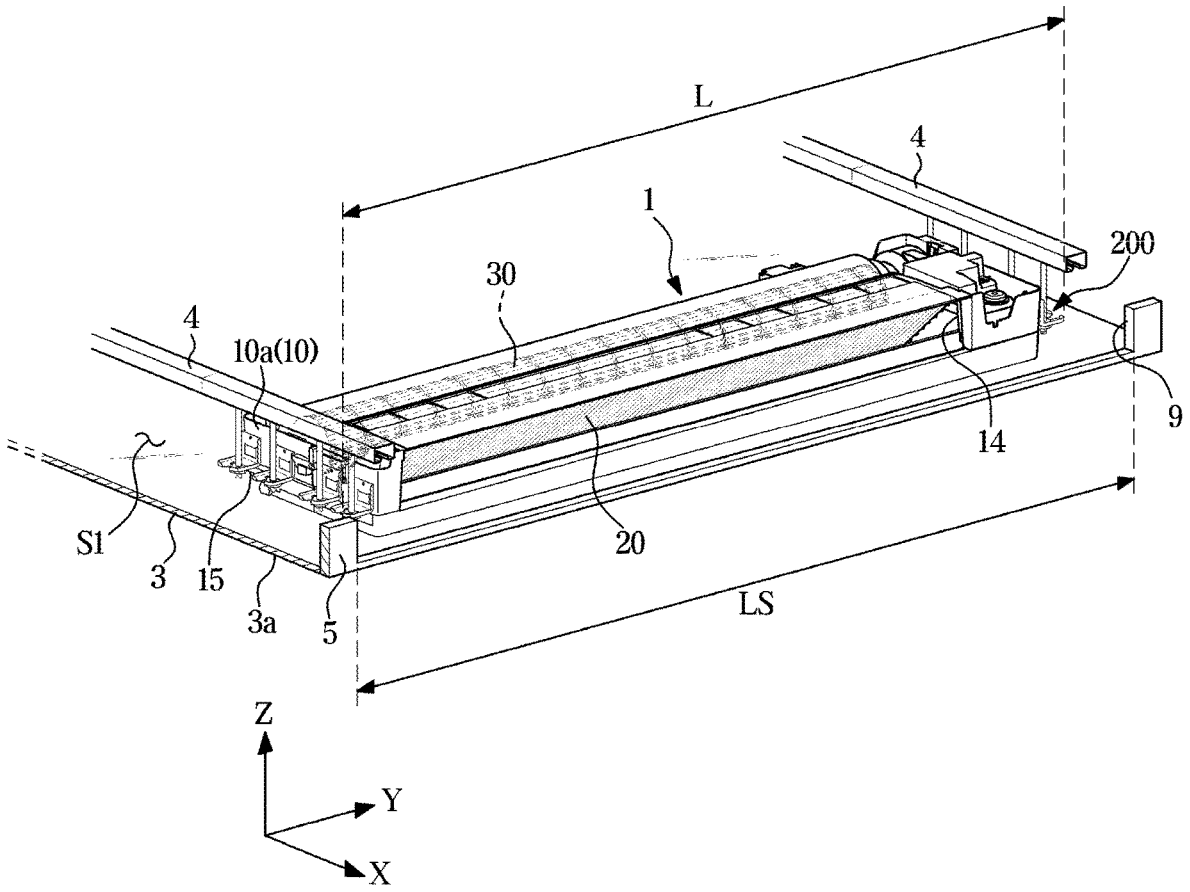
FIG. 2 is a perspective view illustrating the air conditioner of FIG. 1, seen from a different direction.
Figure 3:
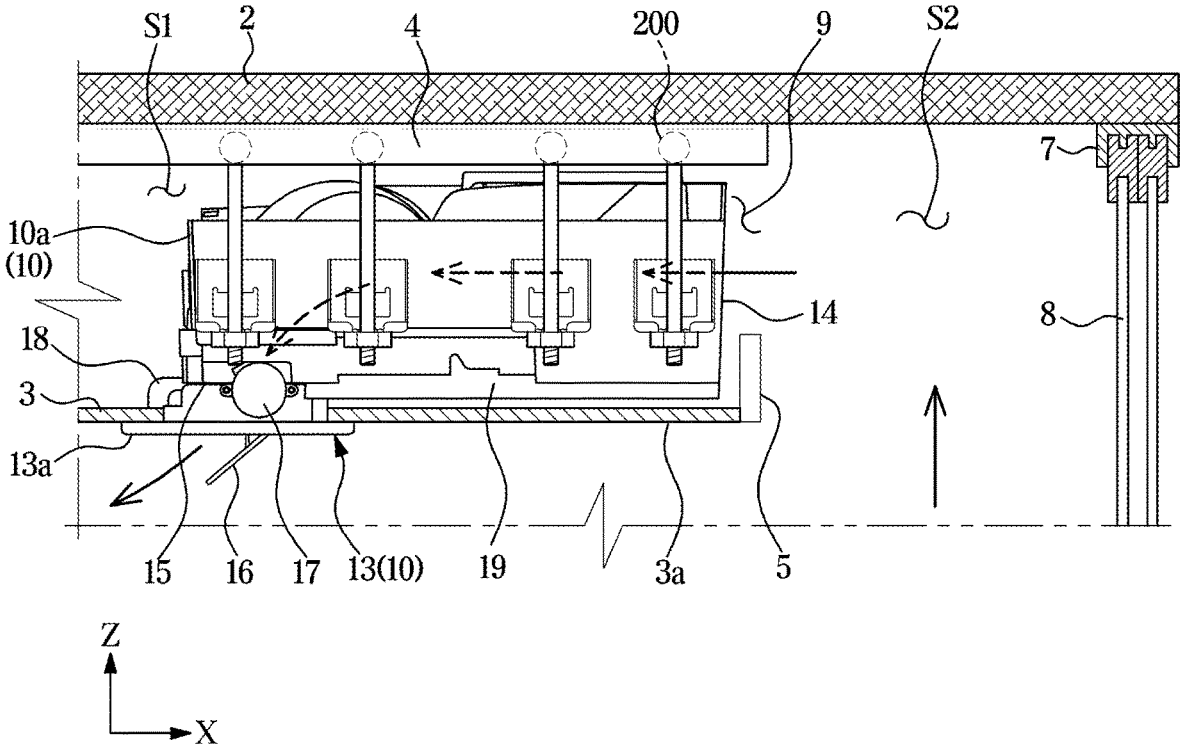
FIG. 3 is a side view illustrating an example of an air conditioner according to an embodiment.

For example, referring to FIGS. 1 to 3, an X direction may refer to a longitudinal direction, a Y direction may refer to a lateral direction, and a Z direction may refer to a height direction. However, this is only designated with reference to the drawings for the sake of convenience of description, and is not limited thereto.

A refrigeration cycle constituting an air conditioner may include a compressor, a condenser, an expansion valve, and an evaporator. The refrigeration cycle may enable circulation in a series of processes including compression-condensation-expansion-evaporation, and supply air having heat exchanged with a refrigerant. Accordingly, the air conditioner may adjust the temperature of the indoor space.

An outdoor unit of the air conditioner may include a compressor and an outdoor heat exchanger. An indoor unit of the air conditioner may include an indoor heat exchanger. An expansion valve may be located in one of the indoor unit and the outdoor unit. The indoor exchanger and the outdoor heat exchanger serve as a condenser or an evaporator. When the indoor heat exchanger is used as a condenser, the air conditioner performs an indoor heating mode. When the indoor heat exchanger is used as an evaporator, the air conditioner performs an indoor cooling mode.

Hereinafter, an embodiment according to the disclosure will be described in detail with reference to the accompanying drawings.

An air conditioner 1 according to an embodiment of the disclosure may be provided using an indoor unit of a ceiling type air conditioner. Hereinafter, the air conditioner 1 will be described.

FIG. 1 is a perspective view illustrating an example of an air conditioner according to an embodiment. FIG. 2 is a perspective view illustrating the air conditioner of FIG. 1, which is seen from a different direction.

Referring to FIGS. 1 and 2, the air conditioner 1 may include a main body 10. The main body 10 may form the external appearance of the air conditioner 1.

The main body 10 may include a housing 10*a* and a discharge panel 13 detachably coupled to a lower portion of the housing 10*a*.

The housing 10*a* may be disposed between a ceiling inner wall 2 (also referred to as a first ceiling 2) and an indoor-side ceiling 3 (also referred to as a second ceiling 3) spaced downward from the ceiling inner wall 2. The air conditioner 1 may be disposed in a first space S1 formed by the ceiling inner wall 2 and the indoor-side ceiling 3.

The main body 10 may include a suction port 14 and a discharge port 15. For example, the housing 10*a* may include the suction port 14 and the discharge port 15.

The suction port 14 may suction indoor air into the main body 10. The discharge port 15 may discharge heat-exchanged air into an indoor area. For example, the suction port 14 may suction air in a lateral direction, and the discharge port 15 may discharge the air in a downward direction.

The suction port 14 may be provided with a grille (not shown) and/or a filter member (not shown) for filtering out dust in the air suctioned to the suction port 14.

The discharge port 15 may be provided with a wind direction control member (not shown) capable of adjusting a leftward and rightward direction (e.g., a Y direction) of the discharged air.

The discharge panel 13 may be provided to correspond to the discharge port 15. The discharge panel 13 may be installed on the indoor-side ceiling 3. The discharge panel 13 may be detachably mounted on the indoor-side ceiling 3. The discharge panel 13 may be exposed downward of the indoor-side ceiling 3. At least a portion of the discharge panel 13 may protrude downward of the indoor-side ceiling 3.

The discharge panel 13 may include a blade 16 provided to open and close the discharge port 15. The blade 16 may guide the air discharged through the discharge port 15. The blade 16 may be rotated by a blade driver 17. For example, the blade driver 17 may be coupled to at least one of the opposite ends in an extending direction (e.g., the Y direction) of the blade 16. For example, the blade driver 17 may include a step motor.

For example, the blade 16 may have a substantially rectangular shape including a pair of long sides and a pair of short sides. The blade 16 may include an approximately plate shape.

The discharge panel 13 may include a panel body 13*a* provided to cover an edge of the blade 16. For example, the panel body 13*a* of the discharge panel 13 may include a front portion 13*b* directed forward with respect to the air discharge direction, a rear portion 13*c* directed rearward with respect to the air discharge direction, and a side portion 13*d* connecting the front portion 13*b* to the rear portion 13*c*.

The discharge panel 13 may include a support rib 18 provided to protrude from the panel body 13*a* toward the first space S1. The support ribs 18 may extend upward from the panel body 13*a*. The support rib 18 may rotatably support the blade 16.

The support rib 18 may extend to connect the front portion 13*b* to the rear portion 13*c* of the panel body 13*a*. The support rib 18 may reinforce the strength of the panel body 13*a*. The support rib 18 may prevent the panel body 13*a* from sagging.

For example, the support rib 18 may be provided in plural, and the plurality of support ribs 18 may be provided to be spaced apart from each other along the extending direction of the blade 16.

A heat exchanger 20 may be provided to allow air suctioned through the suction port 14 to heat-exchange with a refrigerant. The heat exchanger 20 may be accommodated in the housing 10*a*. For example, the heat exchanger 20 may include a tube through which a refrigerant flows and a heat exchange fin coming in contact with the tube to enlarge a heat transfer area. For example, the heat exchanger 20 may be slantingly disposed to be substantially perpendicular to the direction of the air flow.

A blowing fan 30 may force air to flow. The blowing fan 30 may allow indoor air to be suctioned through the suction port 14 or heat-exchanged air to be discharged back into the indoors through the discharge port 15. The blowing fan 30 may be accommodated in the housing 10*a*. The blowing fan 30 may be driven by a fan motor 31 (see FIG. 14).

A drain cover 19 for collecting condensed water generated in the heat exchanger 20 may be provided at a lower side of the heat exchanger 20. For example, the condensed water accommodated in the drain cover 19 may be drained to the outside through a drain hose (not shown) or the like. The drain cover 19 may be provided to support the heat exchanger 20. The drain cover 19 may further include a heat insulating material provided to insulate the heat exchanged air.

The drain cover 19 may be disposed between the ceiling inner wall 2 and the indoor-side ceiling 3. The drain cover 19 may be provided in the first space S1. Accordingly, the drain cover 19 may be covered by the indoor-side ceiling 3 without being exposed downward of the indoor-side ceiling 3.

In general, in the case of a ceiling-type air conditioner, a ceiling panel communicating with each of a suction port and a discharge port of a main body may be mounted on an indoor-side ceiling. In this case, the ceiling panel may include a suction panel corresponding to the suction port and a discharge panel corresponding to the discharge port. The ceiling panel suctions air from a lower side thereof, cools or heats the air, and then discharges the cooled or heated air to the lower side again. Such a ceiling panel is installed on the indoor-side ceiling and protrudes downward from a ceiling surface of the indoor-side ceiling. In addition, the ceiling panel needs to secure an area for communicating with each of the suction port and the discharge port of the main body, and therefore has a large size. In other words, as the area occupied by the ceiling panel in the indoor-side ceiling increases, the area of a portion protruding from the ceiling surface of the ceiling panel may also increase. As a result, the ceiling panel may spoil the aesthetics of indoors.

On the other hand, in the air conditioner 1 according to an embodiment, the indoor aesthetics may be improved by reducing the area of the ceiling panel. The housing 10*a* of the air conditioner 1 may be disposed in the first space S1 formed between the ceiling inner wall 2 and the indoor-side ceiling 3. The housing 10*a* may suction air in a lateral direction from a second space S2 recessed from the indoor-side ceiling 3 toward the ceiling inner wall 2. The housing 10*a* may allow the air suctioned from the second space S2 and heat-exchanged to be discharged in the downward direction. The discharge panel 13 may be coupled to a lower portion of the housing 10*a* to guide the discharge air, and may be mounted on the indoor-side ceiling 3. That is, the housing 10*a* may be covered by the indoor-side ceiling 3 and the discharge panel 13, with only the discharge panel 13 seen by the user when the user views the indoor-side ceiling 3 from the indoors. In other words, only the discharge panel 13 corresponding to the discharge port 15 may be provided on the indoor-side ceiling 3. That is, since the air conditioner 1 may reduce an area by as much as a portion (e.g., a suction panel) corresponding to the suction port in the existing ceiling panel, the ratio of the ceiling panel protruding from a ceiling surface 3*a* may also be reduced. In addition, in the air conditioner 1, only the discharge panel 13 having a relatively neat appearance is exposed, improving aesthetics and appearance quality. In addition, in terms of interior design, excellent aesthetics may be formed.

Meanwhile, the second space S2 may be a space recessed or open from the indoor-side ceiling 3 toward the ceiling inner wall 2. For example, the second space S2 may be a space in which shading members (e.g., curtains, blinds, etc.), lightings, electric wires, piping, and the like are disposed. The second space S2 may include a curtain box. The second space S2 may be adjacent to a window frame 7 and a window 8, but is not limited thereto, and may be provided to be adjacent to a wall structure of indoors.

Referring to FIG. 2, the first space S1 and the second space S2 may communicate with each other. For example, an opening portion 9 for communicating the first space S1 with the second space S2 may be provided. The opening portion 9 may be formed by cutting at least a portion of a vertical panel 5.

The air conditioner 1 is movable toward the second space S2 (e.g., movable in the +X direction), and may be withdrawn from the first space S1 through the second space S2.

For example, a maximum length L in the lateral direction (the Y direction) of the air conditioner 1 may be smaller than a minimum length LS in the lateral direction (the Y direction) of the opening portion 9. A maximum length L in the lateral direction (the Y direction) of the air conditioner 1 may be smaller than a minimum length in the lateral direction (the Y direction) of the second space S2. A maximum length in the longitudinal direction (the X direction) of the air conditioner 1 may be smaller than a minimum length in the longitudinal direction (the X direction) of the second space S2.

Figure 4:
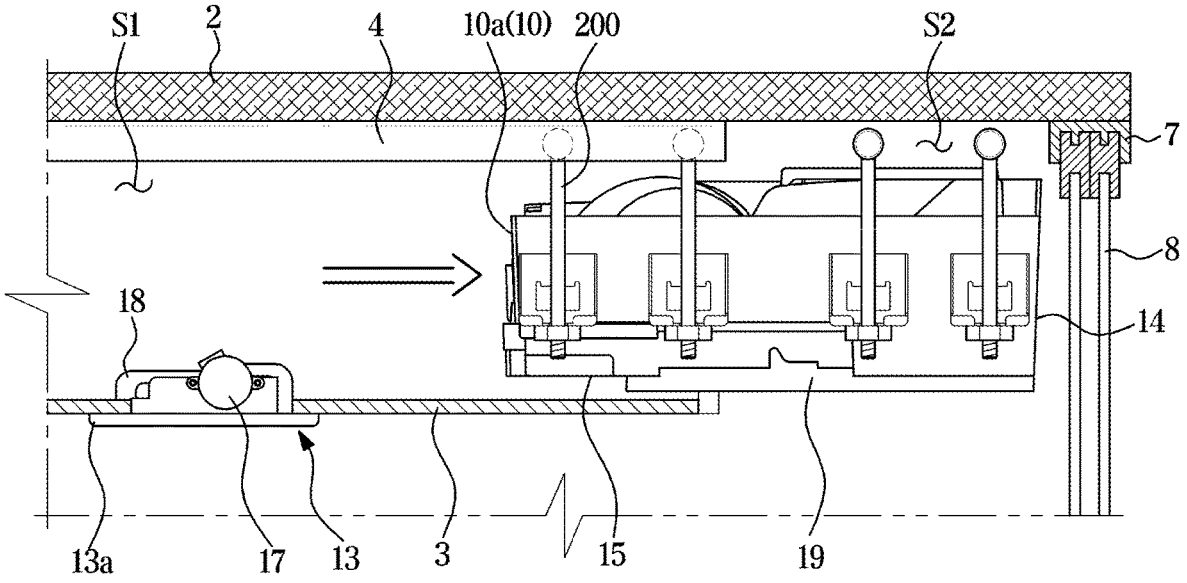
FIG. 4 is a view schematically illustrating a state of an air conditioner shown in FIG. 3 slidably moved.
Figure 5:
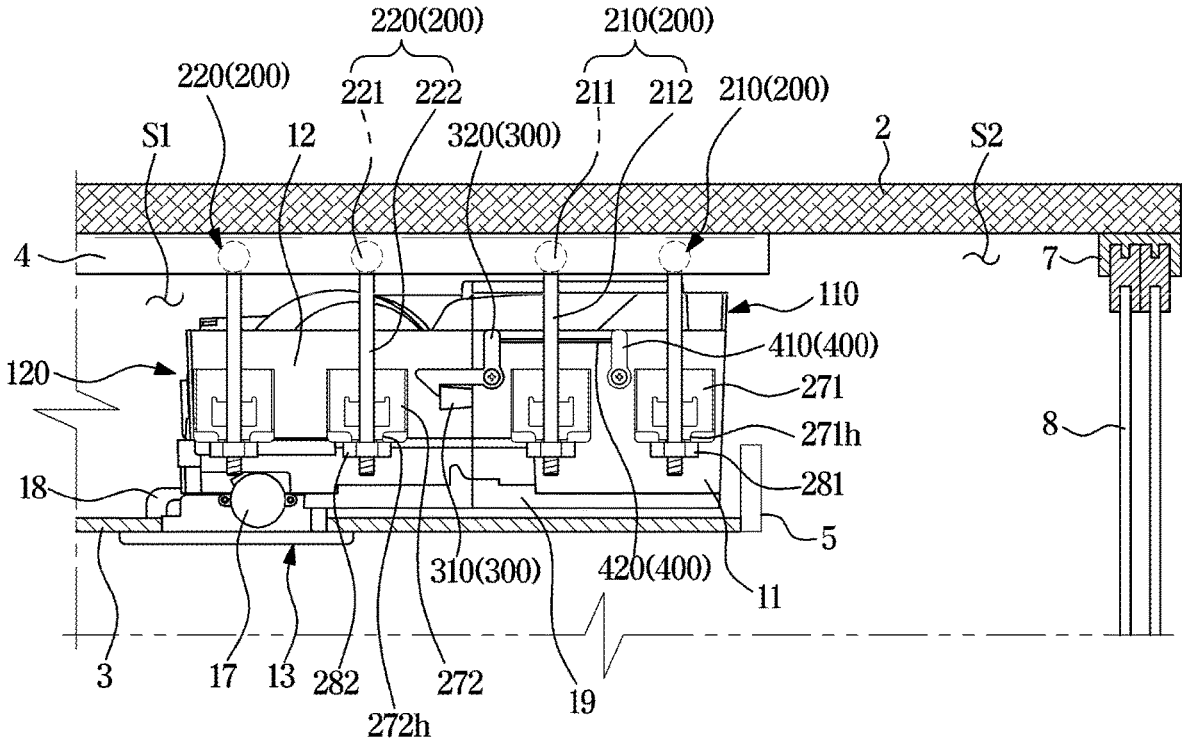
FIGS. 5 to 10 are views illustrating a guide process of an example of an air conditioner according to an embodiment.

FIG. 3 is a side view illustrating an example of an air conditioner according to an embodiment. FIG. 4 is a view schematically illustrating a state of an air conditioner shown in FIG. 3 slidably moved.

Referring to FIG. 3, the air conditioner 1 may suction air from the second space S2, cool or heat the suctioned air, and then discharge the cooled or heated air into the indoors.

For example, the air conditioner 1 may suction air in the lateral direction of the housing 10*a* and discharge the air in the lower direction of the housing 10*a* (see the arrow in FIG. 3). Here, the lateral direction of the housing 10*a* may correspond to the extension direction of a guide rail 4. The lateral direction of the housing 10*a* may correspond to the X direction. However, with respect to the flow of air, the air conditioner 1 may be referred to as suctioning air from the rear side of the housing 10*a* and discharging the air to the front lower side of the housing 10*a*.

The air conditioner 1 may include a guide device 200. The guide device 200 may guide the housing 10*a* of the air conditioner 1 to move toward the second space S2. By the guide device 200, the housing 10*a* may be guided toward the second space S2. For example, the guide device 200 may include moving rollers 211 and 221 provided to be slidably movable along the guide rail 4 and support members 212 and 222 connected to the moving rollers 211 and 221 to support the housing 10*a*. Details thereof will be described below.

Referring to FIG. 4, the housing 10*a* of the air conditioner 1 may be exposed toward the second space S2 by the guide device 200. Accordingly, the operator may access the air conditioner 1 through the second space S2. Since the operator may access the air conditioner 1 through a simple operation (e.g., a sliding movement of the housing 10*a*) without disassembling the components of the air conditioner, the service of the air conditioner 1 may be easily provided.

In FIG. 4, a portion of the housing 10*a* is illustrated as protruding into the second space S2, but the disclosure is not limited thereto. For example, the entire area of the housing 10*a* may protrude into the second space S2 to thereby be withdrawable through the second space S2. In this case, the maximum length along the moving direction of the air conditioner 1 may be provided to be smaller than the minimum length of the second space S2 along the moving direction.

Meanwhile, the 'service' of the air conditioner described in the disclosure may refer to all operations involved for maintenance, repair, inspection, installation or removal of the air conditioner.

FIGS. 5 to 10 are views illustrating a guide process of an example of an air conditioner according to an embodiment.

Referring to FIGS. 5 to 10, an air conditioner 1 may include a plurality of units 110 and 120. The air conditioner shown in FIGS. 5 to 10 may have the same configuration as that of the air conditioner described above, except for including a plurality of air conditioning units. The same reference numerals may be assigned to the same components, and the same descriptions may be omitted. Hereinafter, the air conditioner 1 will be illustrated as including a first air conditioning unit 110 and a second air conditioning unit 120. However, the disclosure is not limited thereto, and the air conditioner 1 may include three or more units.

The first air conditioning unit 110 and the second air conditioning unit 120 may be detachably coupled to each other. A first housing 11 of the first air conditioning unit 110 and a second housing 12 of the second air conditioning unit 120 may be detachably coupled to each other.

For example, the main body 10 of the air conditioner 1 may include the first housing 11 of the first air conditioning unit 110, the second housing 12 of the second air conditioning unit 120, and the discharge panel 13. The housing 10*a* may include the first housing 11 and the second housing 12.

When the first air conditioning unit 110 and the second air conditioning unit 120 are coupled to each other, a flow path through which air flows may be formed in the main body 10. When the first housing 11 and the second housing 12 are coupled to each other, a flow path through which air flows may be formed in the housing 10*a*.

The air conditioner 1 may further include a sealing member (not shown). The sealing member may, when the first housing 11 and the second housing 12 are coupled to each other, prevent the air flowing in the first housing 11 and the second housing 12 from leaking to the outside of the first housing 11 and the second housing 12. The sealing member may be provided between the first housing 11 and the second housing 12. The sealing member may be provided at a portion in which the first housing 11 and the second housing 12 are coupled to each other.

Meanwhile, the first air conditioning unit 110 and the second air conditioning unit 120 may be provided as one body. In this case, the first air conditioning unit 110 and the second air conditioning unit 120 provided as one body is substantially the same as the air conditioner shown in FIGS. 3 and 4, and detailed descriptions thereof will be omitted.

The first air conditioning unit 110 may be disposed in the first space S1 formed between the inner ceiling wall 2 and the indoor-side ceiling 3 spaced downward from the inner ceiling wall 2. The first air conditioning unit 110 may form a part of the air conditioner 1.

The first air conditioning unit 110 may include the first housing 11 forming the external appearance of the first air conditioning unit 110. The first housing 11 may be supported on the ceiling inner wall 2. For example, the first housing 11 may be supported on the ceiling inner wall 2 by a first guide member 210 of the guide device 200 to be described below.

The first air conditioning unit 110 may be provided to suction air from the second space S2 recessed from the indoor-side ceiling 3 toward the ceiling inner wall 2. The first air conditioning unit 100 may include the suction port 14. The suction port 14 may be formed on the lateral side of the first housing 11. The suction port 14 may be provided adjacent to the second space S2. The suction port 14 may communicate with the second space S2.

The first housing 11 of the first air conditioning unit 110 may accommodate the heat exchanger 20. The heat exchanger 20 may be provided to perform heat-exchange on the air suctioned through the suction port 14.

The second air conditioning unit 120 may be disposed in the first space S1 formed between the ceiling inner wall 2 and the indoor-side ceiling 3 spaced downward from the ceiling inner wall 2. The second air conditioning unit 120 may be disposed to communicate with the first air conditioning unit 110 in the first space S1. The second air conditioning unit 120 may form a part of the air conditioner 1.

The second air conditioning unit 120 may include the second housing 12 forming the external appearance of the second air conditioning unit 120. The second housing 12 may be supported on the ceiling inner wall 2. For example, the second housing 12 may be supported on the inner ceiling wall 2 by a second guide member 220 of the guide device 200 to be described below. The second housing 12 may be detachably coupled to the first housing 11.

The second air conditioning unit 120 may be provided to discharge the air introduced from the first air conditioning unit 110. The second air conditioning unit 120 may discharge heat-exchanged air into the indoors. The second air conditioning unit 120 may include the discharge port 15. The discharge port 15 may be formed on the lower side of the second housing 12.

The second housing 12 of the second air conditioning unit 120 may accommodate the blowing fan 30. The blowing fan 30 may be provided to cause the air passed through the heat exchanger 20 to flow to the discharge port 15.

The air conditioner 1 may include the guide device 200 configured to guide the first air conditioning unit 110 and the second air conditioner so that the first air conditioning unit 110 and the second air conditioning unit 120 move toward the second space S2.

The guide device 200 may include the first guide member 210 for guiding the first air conditioning unit 110 and the second guide member 220 for guiding the second air conditioning unit 120.

The guide rail 4 may be installed on or fixed to the ceiling inner wall 2. The guide rail 4 may extend to correspond to the moving direction of the air conditioner 1.

The first guide member 210 may include the first moving roller 211 provided to be slidably movable along the guide rail 4 and the first support member 212 connected to the first moving roller 211 to support the first housing 11. The first support member 212 may extend downward from the first moving roller 211.

The first support member 212 may pass through a hole 271*h* formed in a supporting bracket 271 coupled to the first housing 11. The first support member 212 passed through the hole 271*h* of the supporting bracket 271 may be coupled to a fixing member 281 at a lower side of the supporting bracket 271. The fixing member 281 may have a diameter larger than that of the hole 271*h*. Accordingly, the fixing member 281 may fix the first support member 212 to prevent the first support member 212 from being separated from the supporting bracket 271. For example, the first support member 212 may be a threaded bolt with a thread formed on the outer circumferential surface thereof. For example, the fixing member 281 may be a fastening nut. In addition, a washer (not shown) may be provided between the supporting bracket 271 and the fixing member 281.

However, the disclosure is not limited thereto, and the first support member 212 may be provided as one body with the first housing 11 and support the first housing 11.

The second guide member 220 may include a second moving roller 221 provided to be slidably movable along the guide rail 4 and a second support member 222 connected to the second moving roller 221 to support the second housing 12. The second support member 222 may extend downward from the second moving roller 221.

The second support member 222 may pass through a hole 272*h* formed in a supporting bracket 272 coupled to the second housing 12. The second support member 222 passed through the hole 272*h* of the supporting bracket 272 may be coupled to a fixing member 282 at a lower side of the supporting bracket 272. The fixing member 282 may have a diameter larger than that of the hole 272*h*. Accordingly, the fixing member 282 may fix the second support member 222 to prevent the second support member 222 from being separated from the supporting bracket 272. For example, the second support member 222 may be a threaded bolt with a thread formed on the outer circumferential surface thereof. For example, the fixing member 282 may be a fastening nut. In addition, a washer (not shown) may be provided between the supporting bracket 272 and the fixing member 282.

However, the disclosure is not limited thereto, and the second support member 222 may be provided as one body with the second housing 12 to support the second housing 12.

Except that the first guide member 210 guides the first air conditioning unit 110 and the second guide member 220 guides the second air conditioning unit 120, the shape and the structure of the first guide member 210 may be substantially the same as those of the second guide member 220.

The supporting bracket 271 may be substantially identical to the supporting bracket 272, and the fixing member 281 may be substantially identical to the fixing member 282.

The air conditioner 1 may include a locking device 300 provided to couple the first air conditioning unit 110 to the second air conditioning unit 120.

The locking device 300 may include a locking portion 310 and a hook 320.

The locking portion 310 may be formed on one of the first air conditioning unit 110 and the second air conditioning unit 120, and the hook 320 may be formed on the other one of the first air conditioning unit 110 and the second air conditioning unit 120 to be locked with the locking portion 310.

For example, the locking portion 310 may be formed on the second air conditioning unit 120, and the hook 320 may be formed on the first air conditioning unit 110. Conversely, the locking portion 310 may be formed on the first air conditioning unit 110 and the hook 320 may be formed on the second air conditioning unit 120.

The air conditioner 1 may include an unlocking device 400 provided to release the coupling between the first air conditioning unit 110 and the second air conditioning unit 120 by the locking device 300.

The unlocking device 400 may be connected to the locking device 300 so that the locking device 300 is moved. For example, the unlocking device 400 may rotate the locking device 300 to unlock the locking device 300.

The unlocking device 400 may include a lever 410. The lever 410 may be provided to separate the hook 320 from the locking portion 310.

For example, the unlocking device 400 may further include a connection member 420 connecting the lever 410 to the hook 320. The connection member 420 may move the hook 320 in linkage with the lever 410. The hook 320 may be moved by a predetermined force of the connection member 420 to thereby be released from the locking portion 310. That is, the locking of the hook 320 and the locking portion 310 may be released.

Figure 6:
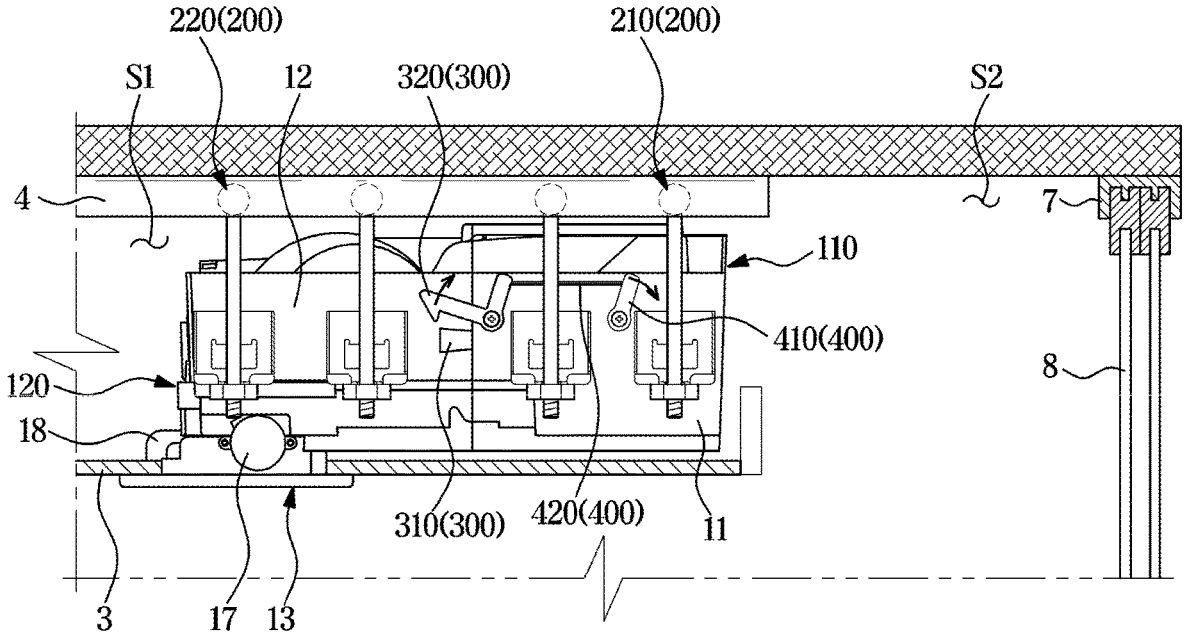

For example, referring to FIG. 6, the lever 410 may rotate to pull the connection member 420, and the connection member 420 in linkage with the rotation of the lever 410 may rotate the hook 320. Accordingly, the locking of the hook 320 and the locking portion 310 may be released.

For example, the connection member 420 may include a wire and/or a chain.

The lever 410 of the unlocking device 400 may be operated manually or automatically. For example, the lever 410 may be operated by an operator or may be operated by a separate lever driver 411 (see FIG. 14).

As the locking of the locking device 300 is released, the first air conditioning unit 110 and the second air conditioning unit 120 may be set into a separable state. The coupling between the first air conditioning unit 110 and the second air conditioning unit 120 may be released. That is, the first housing 11 and the second housing 12 may be separated from each other.

Upon the coupling between the first air conditioning unit 110 and the second air conditioning unit 120 being released, the first air conditioning unit 110 and the second air conditioning unit 120 may move independent of each other. For example, each of the first air conditioning unit 110 and the second air conditioning unit 120 may slide along the guide rail 4. Each of the first air conditioning unit 110 and the second air conditioning unit 120 may move toward the second space S2 to provide a service of the air conditioner.

Upon the coupling between the first air conditioning unit 110 and the second air conditioning unit 120 being released, each of the first air conditioning unit 110 and the second air conditioning unit 120 may be withdrawn from the first space S1 through the second space S2. Upon the first housing 11 of the first air conditioning unit 110 and the second housing 12 of the second air conditioning unit 120 being separated from each other, each of the first air conditioning unit 110 and the second air conditioning unit 120 may be withdrawn from the first space S1 through the second space S2.

Figure 7:
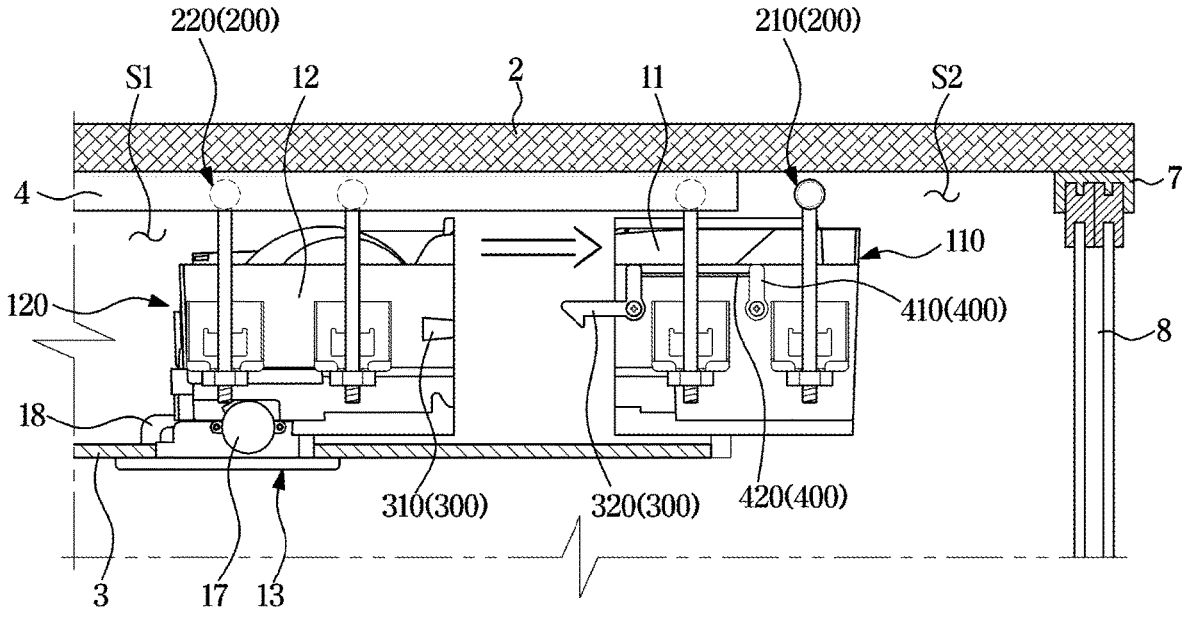

Referring to FIG. 7, after the first housing 11 and the second housing 12 are separated from each other, the first air conditioning unit 110 may be guided by the first guide member 210 to be moved toward the second space S2. The first air conditioning unit 110 may be slidably moved along the guide rail 4.

Figure 8:
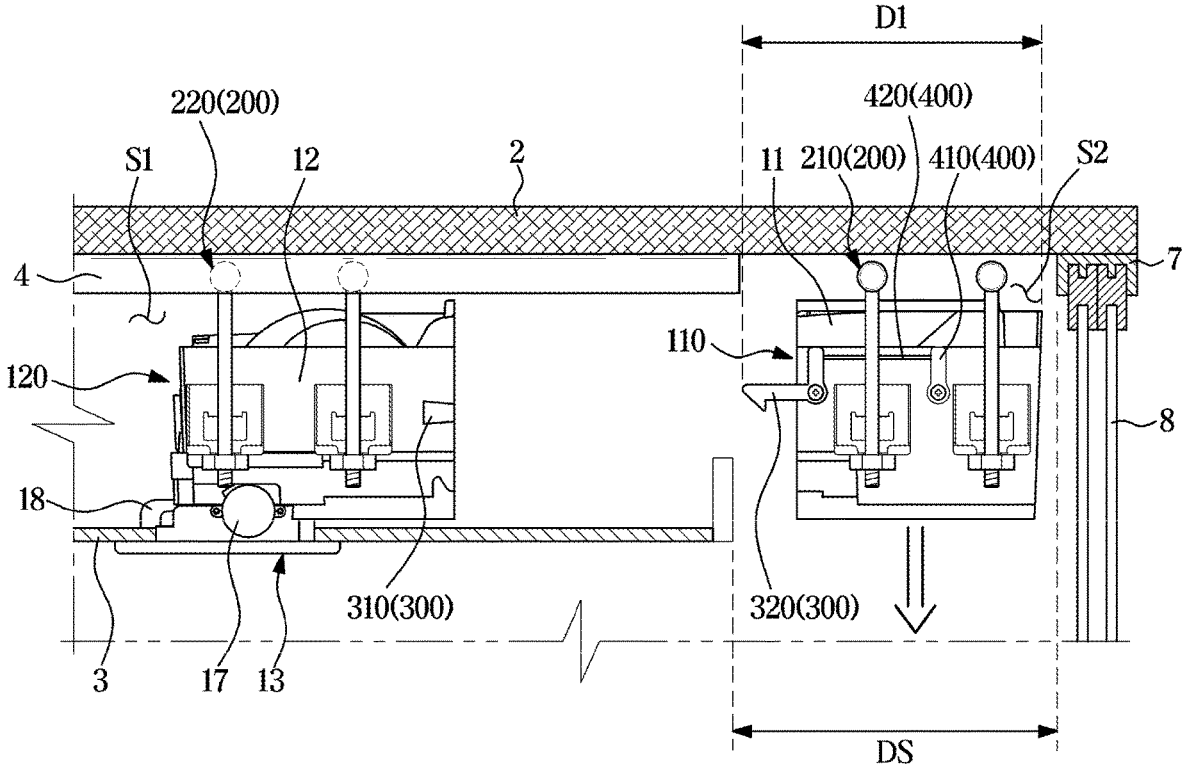

Referring to FIG. 8, the first air conditioning unit 110 may be completely withdrawn from the first space S1 through the second space S2. The first air conditioning unit 110 withdrawn from the first space S1 and provided in the second space S2 may be movable downward. For example, the operator may lower the first air conditioning unit 110 withdrawn from the first space S1. In this case, the maximum length D1 of the first air conditioning unit 110 in the moving direction of the first air conditioning unit 110 may be provided to be smaller than the minimum length DS of the second space S2 in the moving direction.

The first air conditioning unit 110 may be allowed to easily escape from the space between the ceiling inner wall 2 and the indoor-side ceiling 3 by the first guide member 210. That is, by a simple operation (e.g., a sliding movement), the first air conditioning unit 110 may be easily withdrawn from the installation space. Accordingly, a service space for service provision may be more effectively secured and workability, such as maintenance, may be improved.

Figure 9:
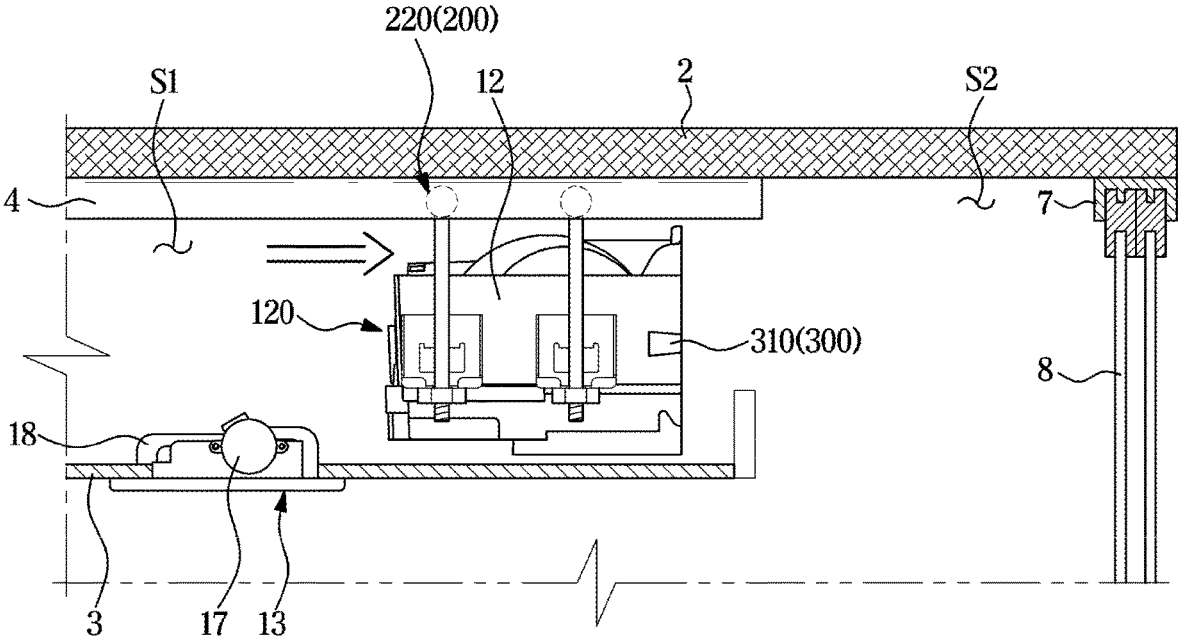

Referring to FIG. 9, after the second housing 12 is separated from the first housing 11, the second air conditioning unit 120 may be guided by the second guide member 220 to be moved toward the second space S2. The second air conditioning unit 120 may be slidably moved along the guide rail 4.

Figure 10:
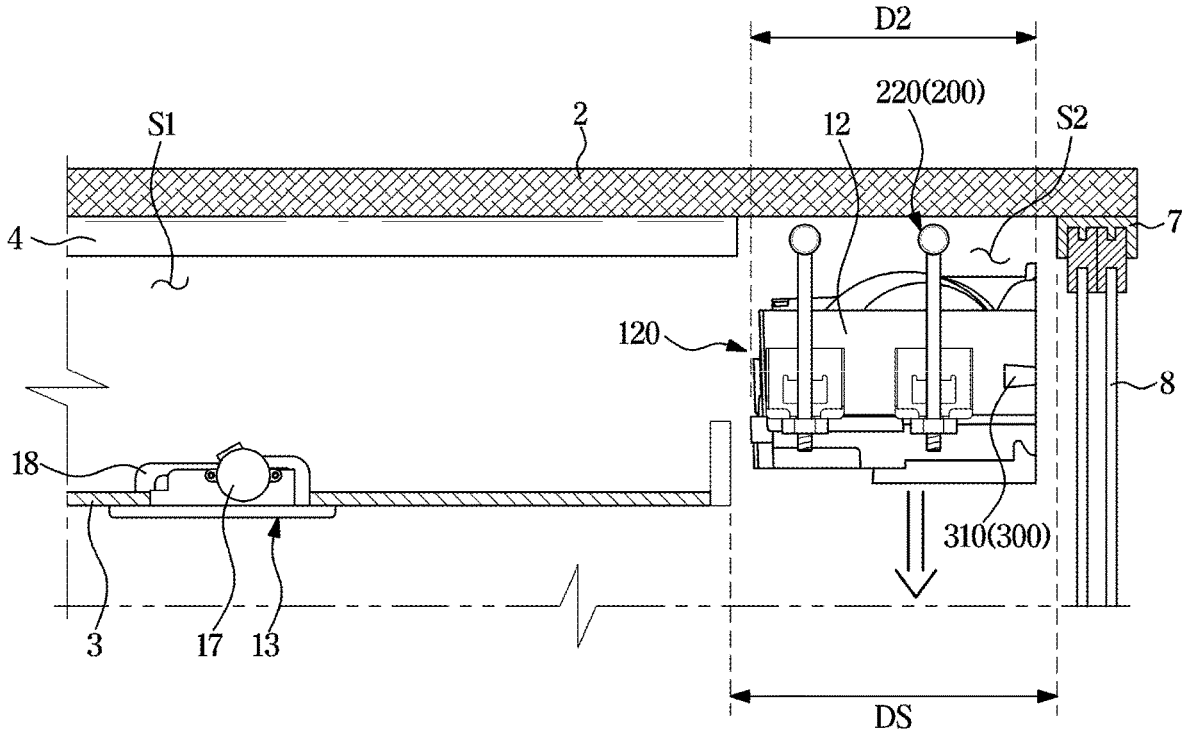

Referring to FIG. 10, the second air conditioning unit 120 may be completely withdrawn from the first space S1 through the second space S2. The second air conditioning unit 120 withdrawn from the first space S1 and provided in the second air space S2 may be movable downward. For example, the operator may lower the second air conditioning unit 120 withdrawn from the first space S1. In this case, the maximum length D2 of the second air conditioning unit 120 in the moving direction of the second air conditioning unit 120 may be provided to be smaller than the minimum length DS of the second space S2 in the moving direction.

The second air conditioning unit 120 may be allowed to easily escape from the space between the ceiling inner wall 2 and the indoor-side ceiling 3 by the second guide member 220. That is, by a simple operation (e.g., a sliding movement), the second air conditioning unit 120 may be easily withdrawn from the installation space. Accordingly, a service space for service provision may be more effectively secured and workability, such as maintenance, may be improved.

Figure 11:
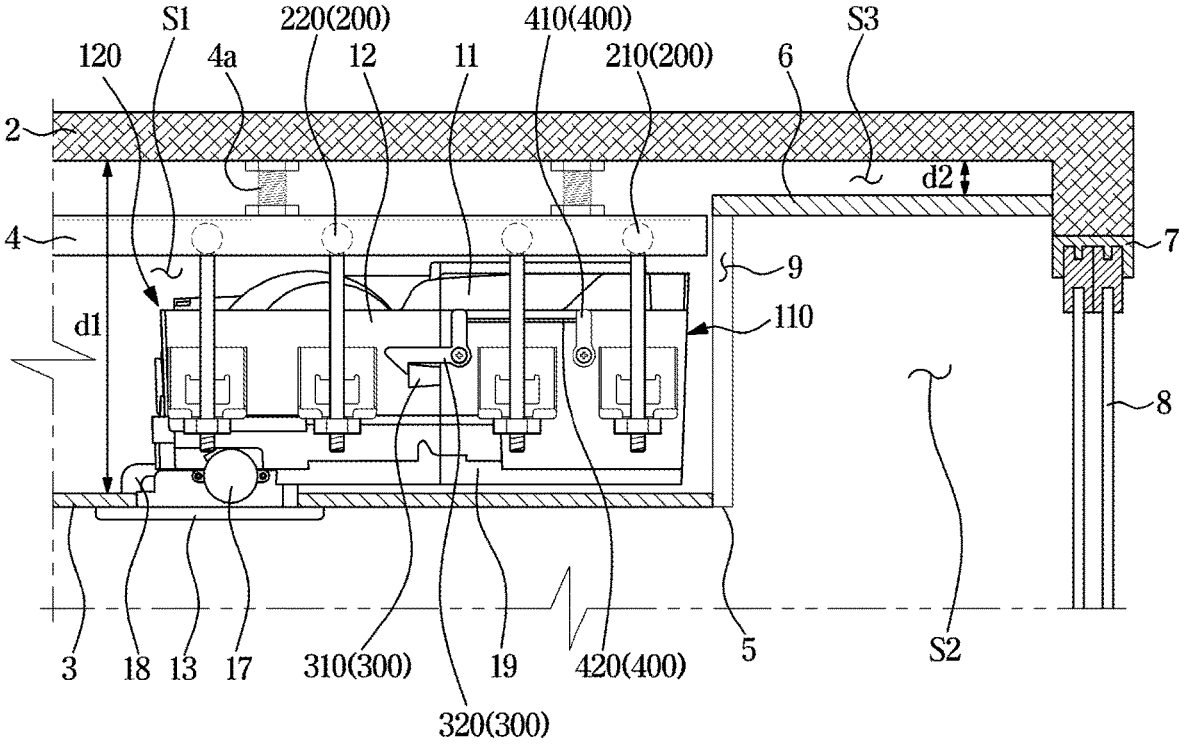
FIG. 11 is a side view illustrating an example of an air conditioner according to an embodiment.

FIG. 11 is a side view illustrating an example of an air conditioner according to an embodiment.

The second space S2 may be a space recessed from the indoor-side ceiling 3 toward the ceiling inner wall 2.

For example, referring to FIG. 11, the first space S1 may be formed between the ceiling inner wall 2 and the indoor-side ceiling 3 spaced apart from the ceiling inner wall 2 by a first interval d1. The second space S2 may be formed by a horizontal panel 6 spaced downward from the ceiling inner wall 2 by a second interval d2 smaller than the first interval d1 and a vertical panel 5 extending from the horizontal panel 6 toward the indoor-side ceiling 3.

That is, the second space S2 is a space formed to be open from the indoor-side ceiling 3 toward the ceiling inner wall 2 (see FIGS. 3 to 10), or a space formed by separate panels 5 and 6 to be recessed from the indoor-side ceiling 3. For example, each of the vertical panel 5 and the horizontal panel 6 may include a ceiling finish, such as gypsum board, plywood, or the like.

In a space S3 formed between the ceiling inner wall 2 and the horizontal panel 6, an electric wire, a pipe, a duct, etc. may be provided.

Referring to FIG. 11, the guide rail 4 may be mounted on the ceiling inner wall 2. The guide rail 4 may be installed on the ceiling inner wall 2. The guide rail 4 may be directly fixed to the ceiling inner wall 2 or may be fixed to the ceiling inner wall 2 by a separate installation member 4*a*.

Figure 12:
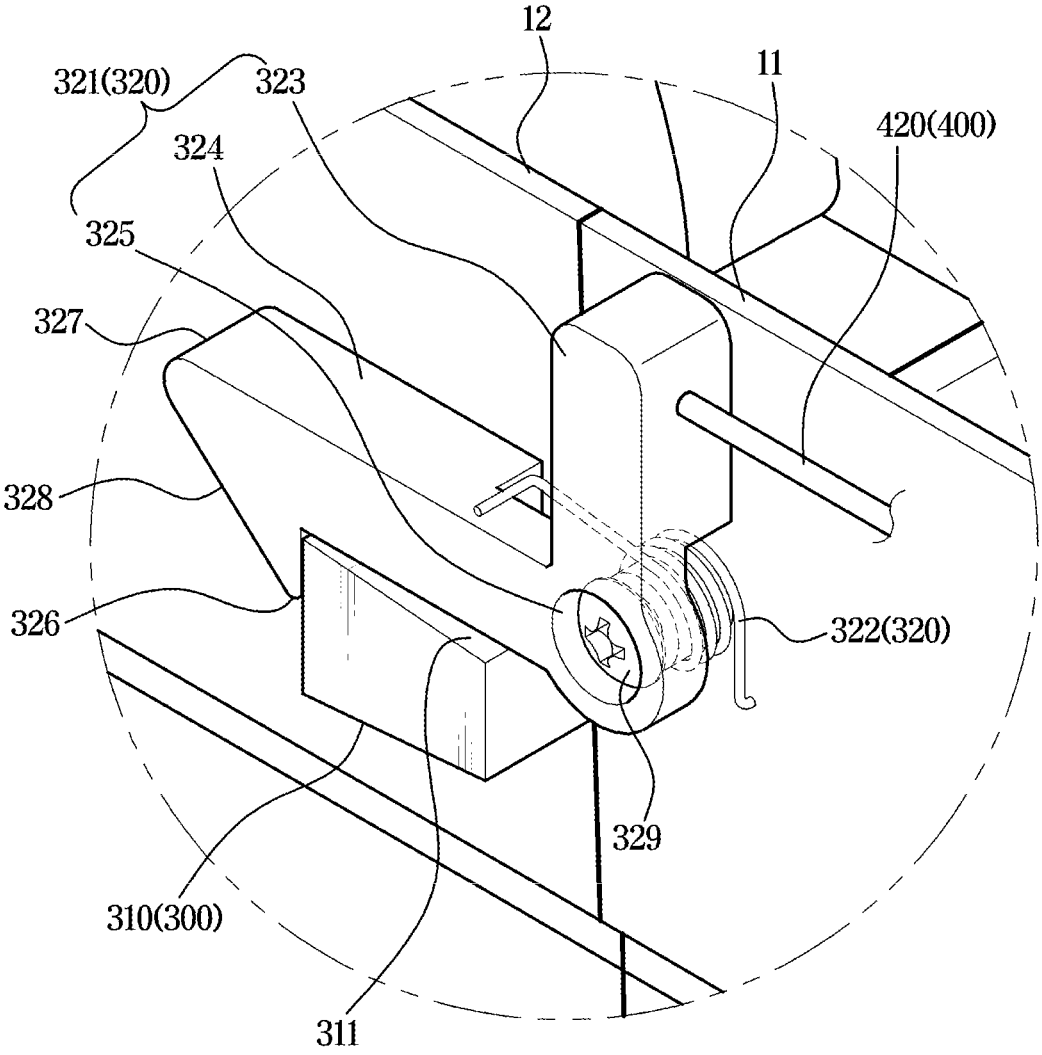
FIG. 12 is an enlarged view of a locking device of an air conditioner according to an embodiment.

FIG. 12 is an enlarged view of a locking device of an air conditioner according to an embodiment.

The locking device 300 may be provided to lock the first air conditioning unit 110 with the second air conditioning unit 120. The locking device 300 may be provided to lock the first housing 11 with the second housing 12.

Referring to FIG. 12, the locking portion 310 may include a first inclined surface 311 provided to guide the hook 320. The first inclined surface 311 may slope upward in a direction in which the first air conditioning unit 110 is coupled to the second air conditioning unit 120. The first inclined surface 311 may slope downward toward the second space S2.

When the first air conditioning unit 110 and the second air conditioning unit 120 are coupled, the hook 320 may be provided to move along the first inclined surface 311 of the locking portion 310 to be locked with the locking portion 310.

The hook 320 may include a hook body 321. The hook body 321 may include a connecting portion 323 connected to the connection member 420, a locking corresponding portion 324 provided to correspond to the locking portion 311, and a rotating portion 325 provided to be rotated by the connection member 420 between the connecting portion 323 and the locking corresponding portion 324.

For example, the connecting portion 323 and the locking corresponding portion 324 may be provided substantially vertically. For example, the locking corresponding portion 324 may have a substantially arrow shape. However, the shape of the hook 320 is not limited thereto, and may be variously provided as long as it can be locked with the locking portion 310.

The locking corresponding portion 324 may include a locking jaw 326 provided to come in contact with the locking portion 310 so as to restrict a sliding movement of the housing in which the hook 320 is formed. In FIG. 12, the locking jaw 326 is illustrated as restricting a sliding movement of the first housing 11, but the disclosure is not limited thereto. For example, when the hook 320 is formed in the second housing 12, the locking jaw 326 may be provided to restrict a sliding movement of the second housing 12.

The locking corresponding portion 324 may include a second inclined surface 328 connecting an end 327 of the locking corresponding portion 324 to the locking jaw 326. The second inclined surface 328 may slope upward in a direction in which the first air conditioning unit 110 is coupled to the second air conditioning unit 120. The second inclined surface 328 may slope downward toward the second space S2.

For example, the inclination angle of the second inclined surface 328 may be provided to be greater than or equal to the inclination angle of the first inclined surface 311. Accordingly, the second inclined surface 328 of the hook 320 may be more easily moved on the first inclined surface 311 of the locking portion 311. However, the disclosure is not limited thereto, and the inclination angle of the second inclined surface 328 may be smaller than the inclination angle of the first inclined surface 311.

The locking device 300 may further include a torsion spring 322 provided to elastically bias the hook 320 in a direction in which the hook 320 is locked with the locking portion 310. For example, the locking device 300 may further include a fastener 329 provided to secure the torsion spring 322.

For example, when a predetermined force is applied to the torsion spring 322 by the unlocking device 400, the torsion spring 322 lifts the locking corresponding portion 324 of the hook 320 to release the locking of the locking portion 310 and the hook 320. When the predetermined force applied to the torsion spring 322 by the unlocking device 400 is removed, the torsion spring 322 elastically biases the locking corresponding portion 324 of the hook 320 to cause the hook 320 to be locked with the locking portion 310 again.

Figure 13:
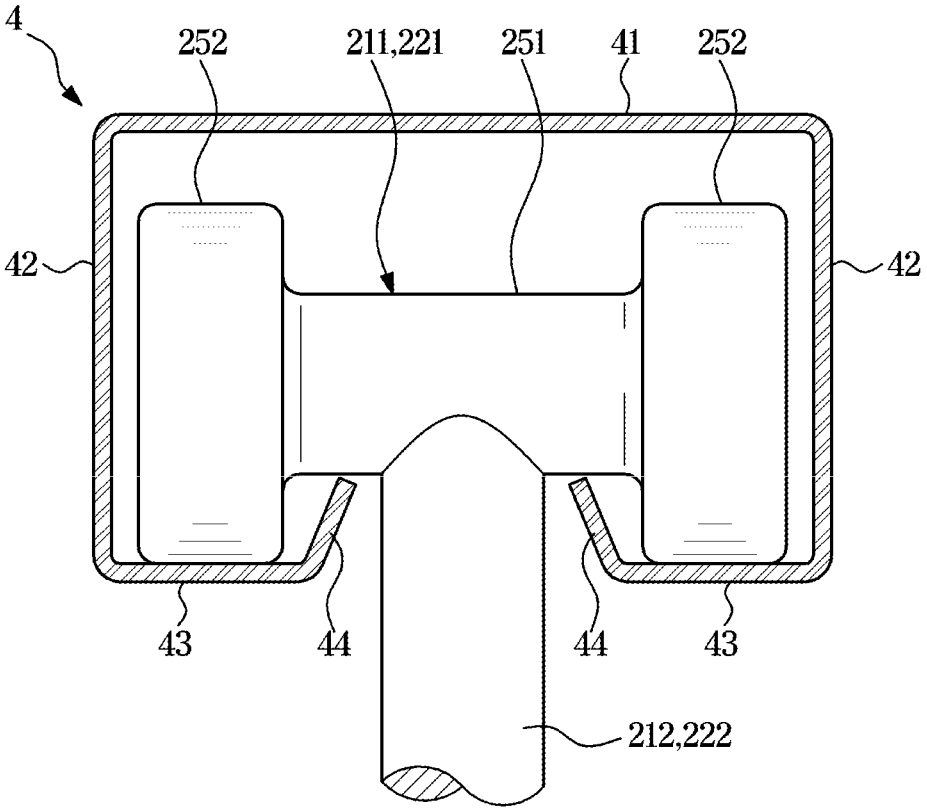
FIG. 13 is an enlarged view of a cross-section of a portion of a guide device of an air conditioner according to an embodiment.

FIG. 13 is an enlarged view of a cross-section of a portion of a guide device of an air conditioner according to an embodiment.

Referring to FIG. 13, the moving rollers 211 and 221 of the guide device 200 may include a roller body 251 and a roller wheel 252. Each of the first moving roller 211 of the first guide member 210 and the second moving roller 221 of the second guide member 220 may include a roller body 251 and a roller wheel 252.

The roller body 251 may form a moving center of the moving roller. The roller wheels 252 may be formed at the opposite ends of the roller body 251 to be supported by the guide rail and rotatable on the guide rail 4.

The guide rail 4 may include a seating portion 43 on which the roller wheel 252 is mounted. The guide rail 4 may include a separation preventing portion 44 extending from the seating portion 43 to prevent separation of the roller wheel 252.

For example, the guide rail 4 may include a plate body 41 installed on the ceiling inner wall 2. The guide rail 4 may include a pair of first bent portions 42 bent in a substantially vertical direction at the opposite ends of the plate body 41 to face each other. The guide rail 4 may include a pair of second bent portions 43 each bent in an approximately horizontal direction at an end of a respective one side of the pair of first bent portions 42. The pair of second bent portions 43 may include a seating portion 43. The guide rail 4 may include a pair of third bent portions 44 each bent upward at an end of a respective one side of the pair of second bent portions 43. The pair of third bent portions 44 may include a separation preventing portion 44.

Figure 14:
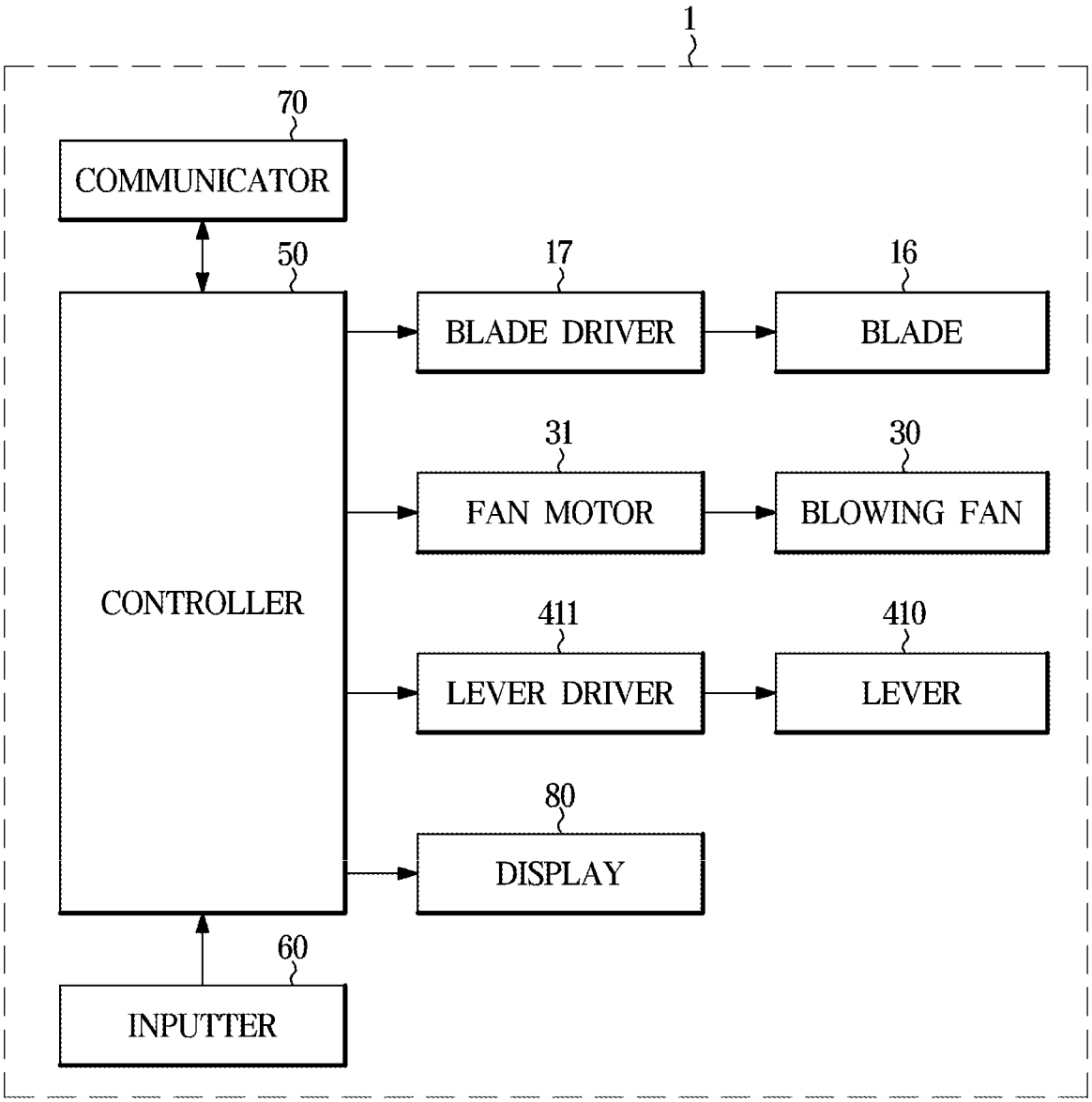
FIG. 14 is a control block diagram of an air conditioner according to an embodiment.
Figure 15:
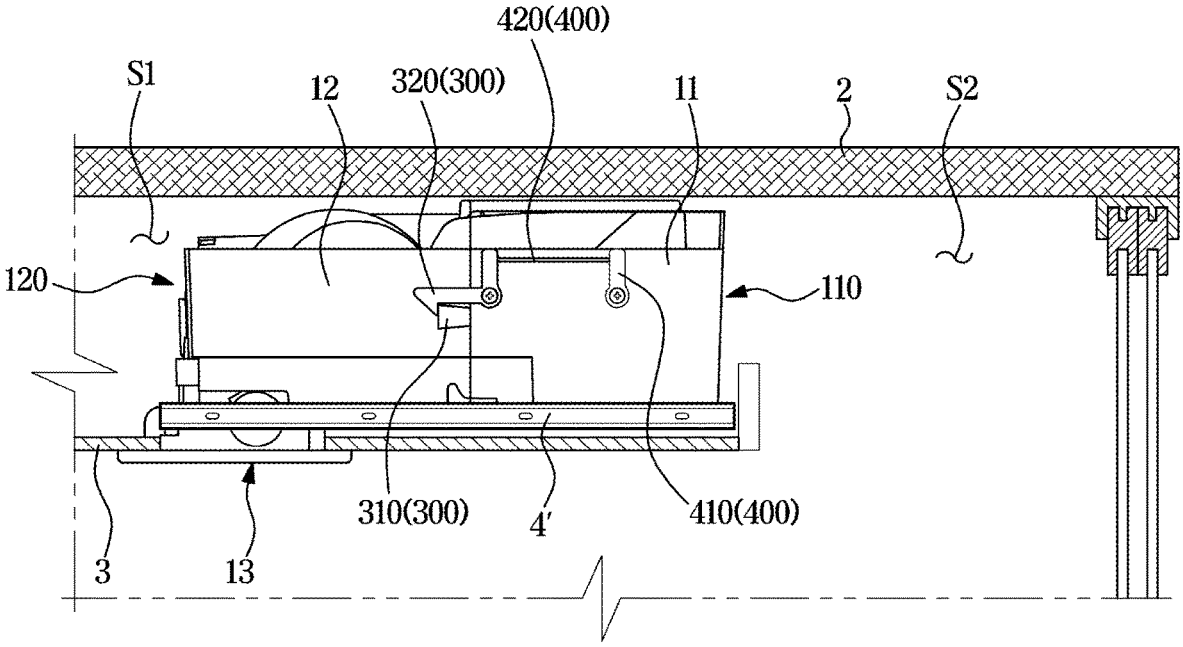
FIGS. 15 to 20 are views illustrating a guide process of an example of the air conditioner according to an embodiment.

FIG. 14 is a control block diagram of an air conditioner according to an embodiment.

Referring to FIG. 14, the air conditioner 1 may include a controller 50, an inputter 60, a communicator 70, a blade driver 17, a blade 16, a fan motor 31, a blowing fan 30, a lever driver 411, a lever 410, and a display 80.

However, each of the components of the air conditioner 1 shown in FIG. 14 may be omitted according to embodiments, and a configuration not shown in FIG. 14 may be added according to embodiments.

The air conditioner 1 may include the controller 50 for controlling the operation of the air conditioner. The controller 50 may control each component of the air conditioner 1. For example, the controller 50 may control the blade driver 17 to adjust the rotation range of the blade 16. The controller 50 may control the fan motor 31 to adjust the blowing force of the blowing fan 31. The controller 50 may control the lever driver 411 to operate the lever 411. A rotation range of the lever 411 may be adjusted by the lever driver 411.

The inputter 60 may receive an input from a user. For example, the controller 50 may control each component of the air conditioner 1 based on information received from the inputter 60. The communicator 70 may communicate with an external terminal (not shown), and may be provided as a wireless communication module. For example, the external terminal may refer to a smart phone, a tablet personal computer (PC), a PC, or the like. The display 80 may display various types of information to the user. For example, the display 80 and the inputter 60 may be integrally provided as a touch panel.

FIGS. 15 to 20 are views illustrating a guide process of an example of the air conditioner according to an embodiment.

Referring to FIGS. 15 to 20, the air conditioner may have the same configuration as that of the above-described air conditioner except that the guide device 200 is different from that of the air conditioner described above. The same reference numerals may be assigned to the same components, and the same descriptions may be omitted.

A guide rail 4' may be disposed between the ceiling inner wall 2 and the indoor-side ceiling 3. The guide rail 4' may be disposed on the indoor-side ceiling 3. Although not shown in the drawings, the guide rail 4' may be provided to be supported on the ceiling inner wall 2 by a separate support member (not shown).

The first air conditioning unit 110 and the second air conditioning unit 120 may be detachably coupled to each other. The first housing 11 of the first air conditioning unit 110 and the second housing 12 of the second air conditioning unit 120 may be detachably coupled to each other.

The guide device 200 may include a first moving rail 230 for guiding the first air conditioning unit 110. The first moving rail 230 may extend to correspond to the guide rail 4'. The first moving rail 230 may be provided to be slidably movable along the guide rail 4'. The first moving rail 230 may be formed on the first housing 11 of the first air conditioning unit 110.

The guide device 200 may include a second moving rail 240 for guiding the second air conditioning unit 120. The second moving rail 240 may extend to correspond to the guide rail 4'. The second moving rail 240 may be provided to be slidably movable along the guide rail 4'. The second moving rail 240 may be formed on the second housing 12 of the second air conditioning unit 120.

Figure 16:
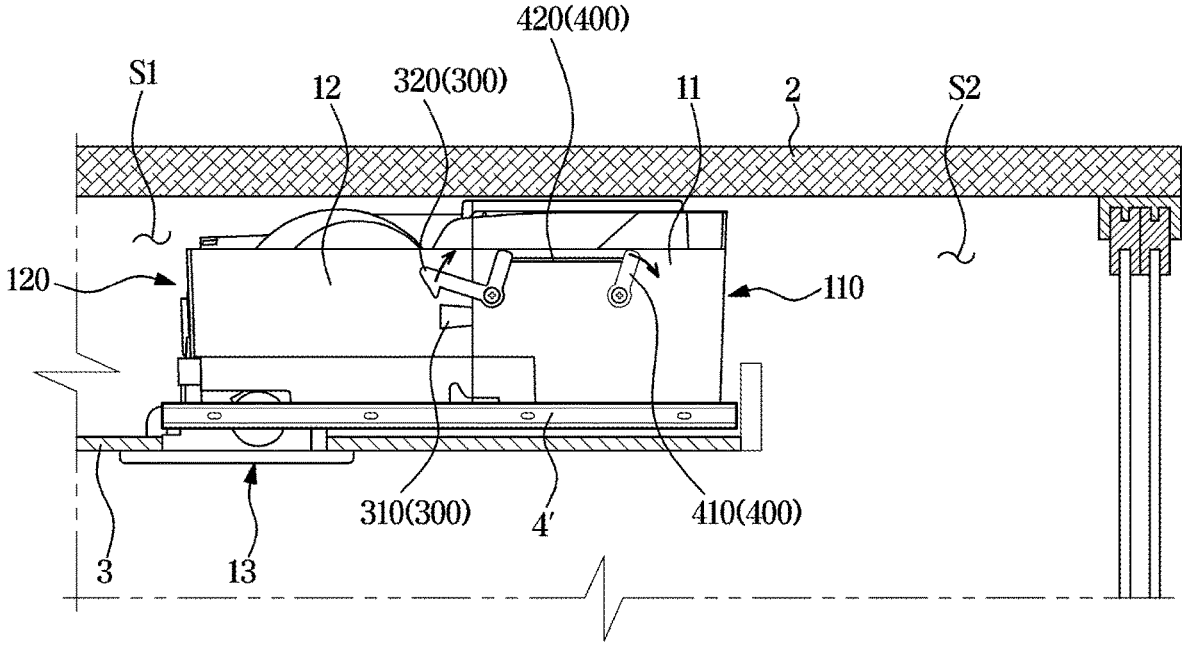

Referring to FIG. 16, as the lever 410 is driven, the connection member 420 may be moved in linkage with the lever 410. The hook 320 may be separated from the locking portion 310 by a predetermined force of the connection member 420. That is, the hook 320 may be released from the locking portion 310. Locking of the locking portion 310 and the locking portion 310 may be released.

As the locking of the locking portion 310 and the locking portion 310 is released, the coupling between the first air conditioning unit 110 and the second air conditioning unit 120 may be released. The first air conditioning unit 110 and the second air conditioning unit 120 may be set into a separable state.

Upon the coupling between the first air conditioning unit 110 and the second air conditioning unit 120 being released, the first air conditioning unit 110 and the second air conditioning unit 120 may be moved individually. The first air conditioning unit 110 may slide along the guide rail 4'. The second air conditioning unit 120 may slide along the guide rail 4'.

Figure 17:
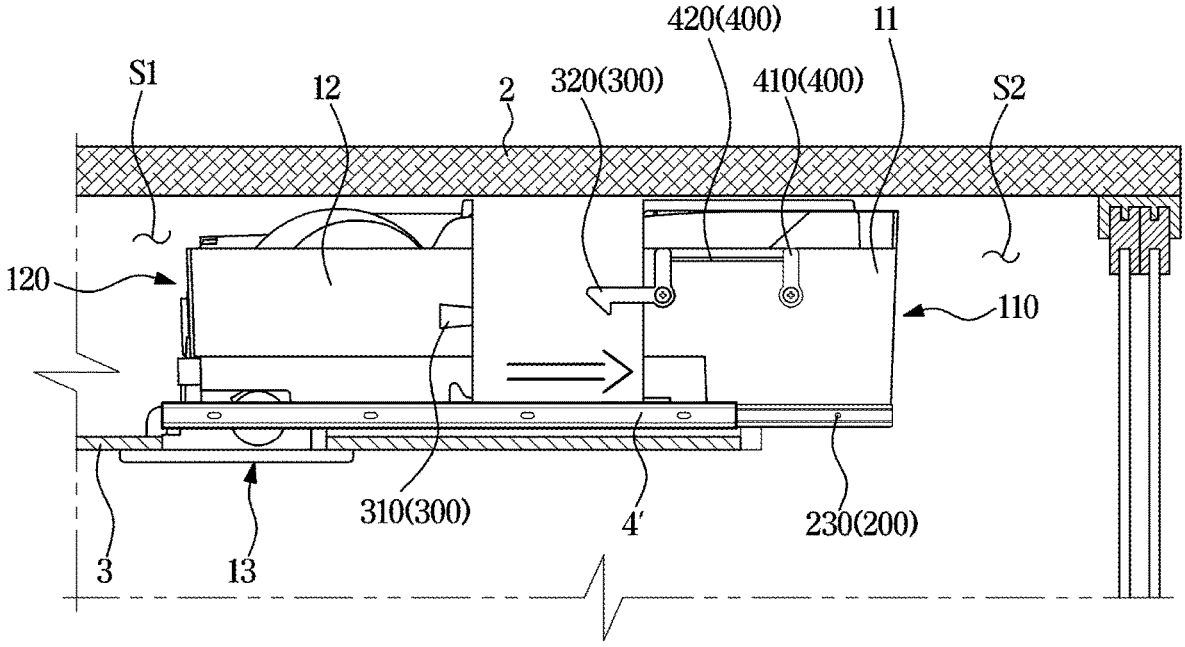
Figure 18:
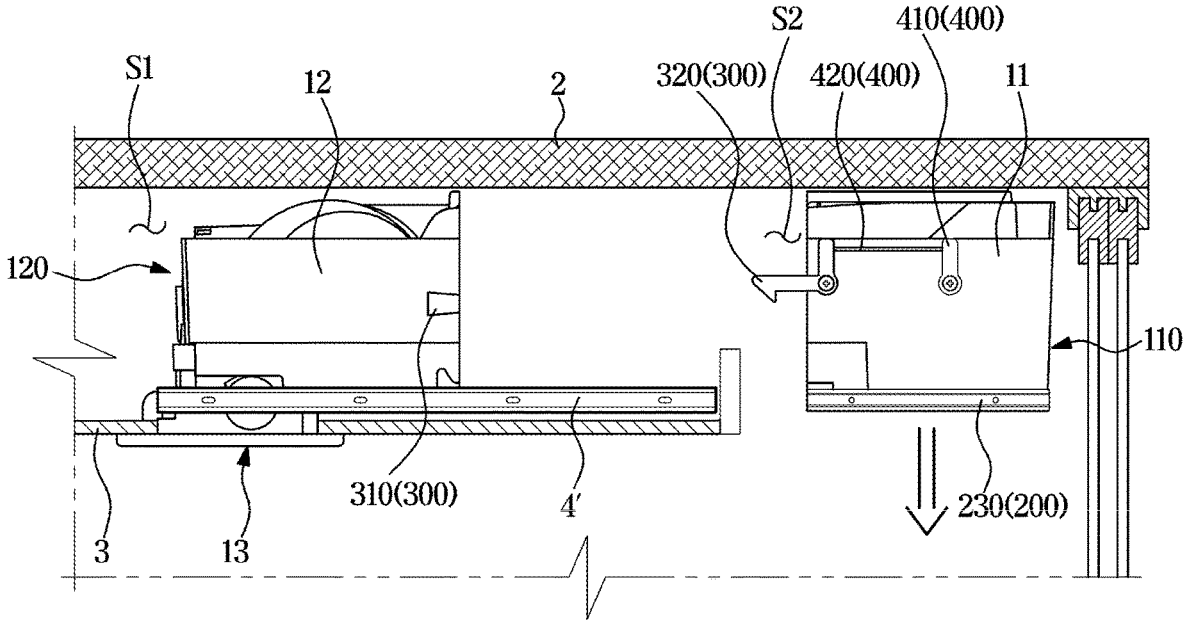

Referring to FIG. 17, the first air conditioning unit 110 may be guided by the first moving rail 230 to slidably move toward the second space S2. Referring to FIG. 18, the first air conditioning unit 110 may be withdrawn from the first space S1 through the second space S2. The maximum length of the first air conditioning unit 110 in the moving direction of the first air conditioning unit 110 may be smaller than the minimum length of the second space S2 in the moving direction.

The first air conditioning unit 110 may escape from an area between the ceiling inner wall 2 and the indoor-side ceiling 3 through the first moving rail 230. Accordingly, a service space may be effectively secured, and maintenance may be facilitated.

Figure 19:
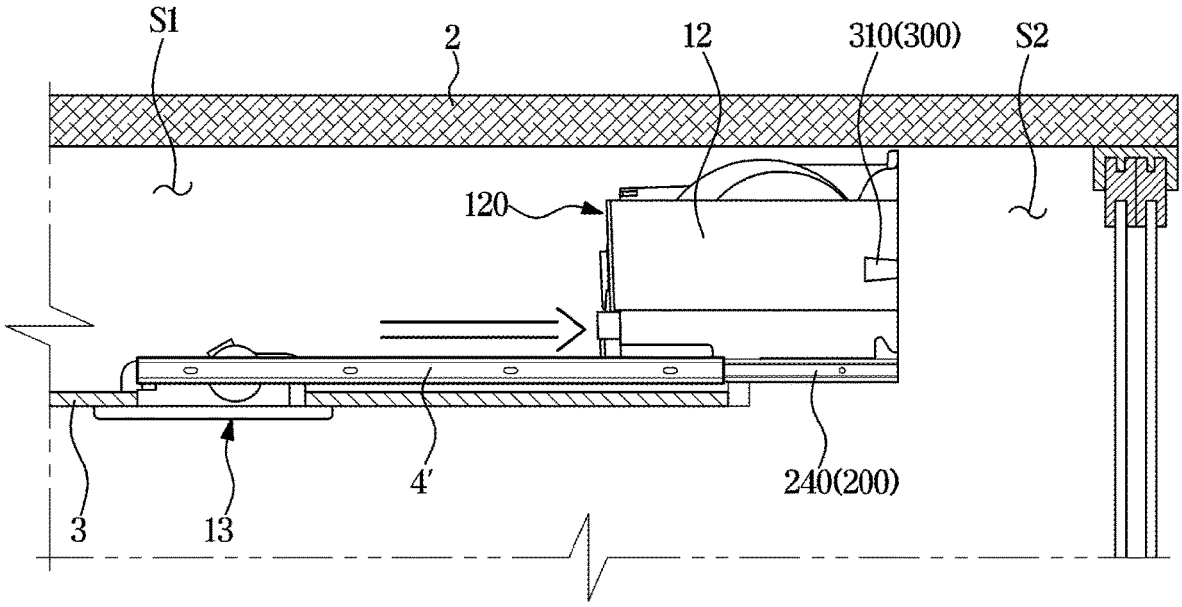
Figure 20:
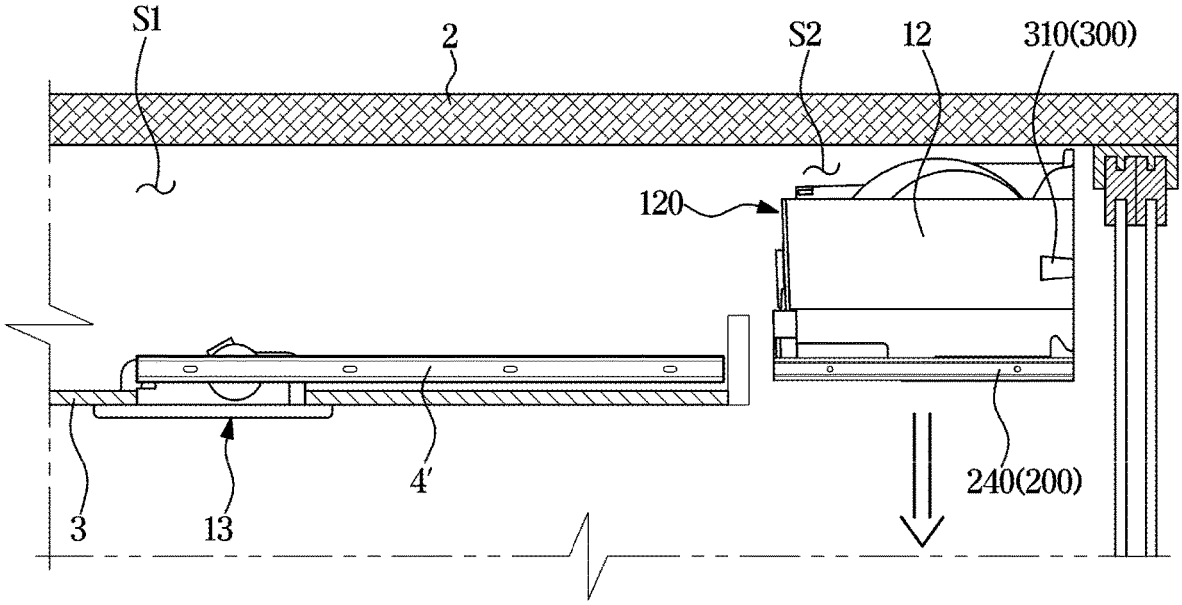

Referring to FIG. 19, the second air conditioning unit 120 may be guided by the second moving rail 240 to slidably move toward the second space S2. Referring to FIG. 20, the second air conditioning unit 120 may be withdrawn from the first space S1 through the second space S2. The maximum length of the second air conditioning unit 120 in the moving direction of the second air conditioning unit 120 may be smaller than the minimum length of the second space S2 in the moving direction.

The second air conditioning unit 120 may escape from an area between the ceiling inner wall 2 and the indoor-side ceiling 3 through the second moving rail 240. Accordingly, a service space may be effectively secured, and maintenance may be facilitated.

Meanwhile, the first air conditioning unit 110 and the second air conditioning unit 120 may be provided as one body with each other. The first moving rail 230 and the second moving rail 240 may also be provided as one body. In this case, one moving rail 230 or 240 provided in the air conditioner may slidably move along the guide rail 4'.

As shown above, according to one aspect of the disclosure, the air conditioner can be provided with an improved appearance quality.

According to one aspect of the disclosure, the air conditioner can be provided with ease of maintenance, such as replacement of parts and inspection.

According to one aspect of the disclosure, the air conditioner can secure a service space.

Although certain illustrative embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. An air conditioner comprising:

a first air conditioning unit disposed in a first space formed between a first ceiling and a second ceiling that is spaced downward from the first ceiling and lower than the first ceiling, the first air conditioning unit being configured to suction air from a second space that is recessed from the second ceiling toward the first ceiling;

a second air conditioning unit, disposed in the first space, to communicate with the first air conditioning unit, the second air conditioning unit being configured to discharge air introduced from the first air conditioning unit; and a guide device configured to guide at least one of the first air conditioning unit and the second air conditioning unit along a guide rail installed on the first ceiling to move from the first space toward the second space or to move from the second space toward the first space, wherein the first air conditioning unit and the second air conditioning unit are detachably coupled to each other, and the air conditioner further comprises a locking device configured to couple the first air conditioning unit to the second air conditioning unit.

2. The air conditioner of claim 1, further comprising an unlocking device to be connected to the locking device to release the coupling between the first air conditioning unit and the second air conditioning unit by the locking device.

3. The air conditioner of claim 2, wherein the locking device further includes:

a locking portion formed on one of the first air conditioning unit and the second air conditioning unit, and a hook formed on an other one of the first air conditioning unit and the second air conditioning unit to be locked by the locking portion, and the unlocking device further includes a lever to separate the hook from the locking portion.

4. The air conditioner of claim 3, wherein the unlocking device further includes a connection member connecting the lever to the hook and configured to rotate the hook in linkage with the lever.

5. The air conditioner of claim 3, wherein the locking portion of the locking device further includes an inclined surface sloping upward in a direction in which the first air conditioning unit is coupled to the second air conditioning unit, and in response to coupling the first air conditioning unit and the second air conditioning unit to each other, the hook of the locking device moves along the inclined surface of the locking portion to be locked with the locking portion.

6. The air conditioner of claim 3, wherein the locking device further includes a torsion spring to elastically bias the hook in a direction in which the hook is locked with the locking portion.

7. The air conditioner of claim 1, wherein the first air conditioning unit further includes a first housing supported by the first ceiling and a suction port formed at a lateral side of the first housing while communicating with the second space; and the second air conditioning unit further includes a second housing supported by the first ceiling and detachably coupled to the first housing and a discharge port formed at a lower side of the second housing to discharge the air introduced from the first air conditioning unit.

8. The air conditioner of claim 7, wherein in response to separating the first housing of the first air conditioning unit and the second housing of the second air conditioning unit from each other, each of the first air conditioning unit and the second air conditioning unit is withdrawable from the first space through the second space.

9. The air conditioner of claim 7, wherein the guide device includes:

a first guide member configured to guide the first air conditioning unit, the first guide member including a first moving roller slidably movable along the guide rail installed on the first ceiling and a first support member connected to the first moving roller to support the first housing; and a second guide member configured to guide the second air conditioning unit, the second guide member including a second moving roller slidably movable along the guide rail and a second support member connected to the second moving roller to support the second housing.

10. The air conditioner of claim 9, wherein each of the first moving roller and the second moving roller further includes:

a roller body forming a moving center; and roller wheels formed at opposite ends of the roller body to be supported by the guide rail, and to rotate on the guide rail, wherein the guide rail further includes:

a seating portion on which the roller wheels are seated; and a separation preventing portion extending from the seating portion to prevent separation of the roller wheels.

11. The air conditioner of claim 7, wherein the guide device includes:

a first moving rail configured to guide the first air conditioning unit, the first moving rail formed on the first housing of the first air conditioning unit and slidably movable along the guide rail which is disposed between the first ceiling and the second ceiling; and a second moving rail configured to guide the second air conditioning unit, the second moving rail formed on the second housing of the second air conditioning unit and slidably movable along the guide rail.

12. The air conditioner of claim 7, further comprising:

a heat exchanger accommodated in the first housing of the first air conditioning unit to exchange heat with the air suctioned through the suction port; and a fan accommodated in the second housing of the second air conditioning unit to guide the air passed through the heat exchanger to flow toward the discharge port.

13. The air conditioner of claim 7, further comprising a discharge panel installed on the second ceiling to correspond to the discharge port and exposed downward of the second ceiling.

14. The air conditioner of claim 1, wherein a maximum length of the first air conditioning unit in a moving direction of the first air conditioning unit is smaller than a minimum length of the second space in the moving direction, and a maximum length of the second air conditioning unit in the moving direction is smaller than the minimum length of the second space in the moving direction.

15. An air conditioner including:

a first housing slidably movable in a first space formed between a first ceiling and a second ceiling that is spaced downward from the first ceiling by a first interval;

a suction port formed in the first housing and configured to communicate with a second space formed by a horizontal panel spaced downward from the first ceiling by a second interval smaller than the first interval and a vertical panel extending from the horizontal panel toward the second ceiling, and to suction air from the second space therethrough;

a heat exchanger accommodated in the first housing and to heat-exchange with the air suctioned through the suction port;

a second housing detachably coupled to the first housing and slidably movable in the first space;

a discharge port formed in the second housing to discharge air to indoors; and a fan accommodated in the second housing to allow the air having heat exchanged with the heat exchanger to flow to the discharge port, wherein each of the first housing and the second housing is withdrawable from the first space through the second space.

16. The air conditioner of claim 15, further comprising a locking device to allow the first housing and the second housing to be locked with each other and an unlocking device to move the locking device such that locking of the first housing and the second housing by the locking device is released.

17. The air conditioner of claim 16, wherein the locking device further comprises a locking portion formed on the second housing and a hook formed on the first housing to be locked with the locking portion, and the unlocking device further includes a wire connected to the hook and a lever to pull the wire such that the hook is unlocked from the locking portion.

18. The air conditioner of claim 15, further comprising a guide device to guide a sliding movement of the first housing and a sliding movement of the second housing such that the first housing and the second housing are movable between the first space and the second space.

19. The air conditioner of claim 15, further comprising a sealing member between the first housing and the second housing such that, in response to coupling the first housing to the second housing, air flowing in the first housing and the second housing is prevented from leaking to an outside of the first housing and the second housing.

* * * * *